US007173614B2

(12) United States Patent
Morita

(10) Patent No.: US 7,173,614 B2
(45) Date of Patent: Feb. 6, 2007

(54) POWER SUPPLY CIRCUIT, DISPLAY DRIVER, AND VOLTAGE SUPPLY METHOD

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 377 days.

(21) Appl. No.: 10/891,195

(22) Filed: Jul. 15, 2004

(65) Prior Publication Data

US 2005/0057231 A1 Mar. 17, 2005

(30) Foreign Application Priority Data

Jul. 18, 2003 (JP) ..... 2003-277030

(51) Int. Cl.
*G09G 5/00* (2006.01)

(52) U.S. Cl. ..... 345/211; 345/212; 345/213; 345/52; 345/53; 345/94; 345/95; 345/87; 345/89; 345/204; 345/208; 345/209; 345/210; 345/690; 713/300; 713/310; 348/730

(58) Field of Classification Search ..... 713/300, 713/310; 348/730; 345/211–213, 52, 53, 345/94, 95, 87, 89, 204, 208–210
See application file for complete search history.

(56) References Cited

U.S. PATENT DOCUMENTS 5,912,655 A * 6/1999 Hoshino et al. ..... 345/100
6,492,970 B1 * 12/2002 Furuhashi et al. ..... 345/94
2005/0052890 A1 3/2005 Morita
2005/0078078 A1 4/2005 Morita

FOREIGN PATENT DOCUMENTS

JP A 7-181924 7/1995
JP A 2001-312257 11/2001
JP A 2002-149133 5/2002
JP A 2003-058118 2/2003

* cited by examiner

*Primary Examiner*—Richard Hjerpe
*Assistant Examiner*—Jennifer T. Nguyen
(74) *Attorney, Agent, or Firm*—Oliff & Berridge, PLC

(57) ABSTRACT

In the case of supplying voltage to a common electrode which faces a pixel electrode through electro-optical substance while changing the voltage from a first low-potential-side voltage to a first high-potential-side voltage, a second high-potential-side voltage, which is higher than the first high-potential-side voltage, is supplied to the common electrode instead of the first low-potential-side voltage, and the first high-potential-side voltage is then supplied to the common electrode. One of the first high-potential-side voltage and a first intermediate voltage, which is lower than the first high-potential-side voltage but higher than the first low-potential-side voltage, may be supplied to the common electrode before supplying the second high-potential-side voltage to the common electrode.

17 Claims, 23 Drawing Sheets

POWER SUPPLY CIRCUIT, DISPLAY DRIVER, AND VOLTAGE SUPPLY METHOD

Japanese Patent Application No. 2003-277030, filed on Jul. 18, 2003, is hereby incorporated by reference in its entirety.

BACKGROUND OF THE INVENTION

The present invention relates to a power supply circuit, a display driver, and a voltage supply method.

An active matrix liquid crystal display device includes a plurality of scanning lines and a plurality of data lines formed in a matrix. The active matrix liquid crystal display device includes a plurality of switching devices, each of the switching devices being connected with one of the scanning lines and one of the data lines, and a plurality of pixel electrodes, each of the pixel electrodes being connected with one of the switching devices. Each pixel electrode faces a common electrode through a liquid crystal (electro-optical substance in a broad sense).

In the liquid crystal display device having such a configuration, voltage supplied to the data line is applied to the pixel electrode through the switching device which is turned ON through the selected scanning line. The transmissivity of a pixel changes corresponding to the voltage applied between the pixel electrode and the common electrode.

BRIEF SUMMARY OF THE INVENTION

One aspect of the present invention relates to a power supply circuit for supplying voltage to a common electrode which faces a pixel electrode through an electro-optical substance, the power supply circuit including:

a common electrode voltage supply circuit which supplies one of a first high-potential-side voltage, a first low-potential-side voltage, a second high-potential-side voltage, and a first intermediate voltage to the common electrode based on a select signal, the second high-potential-side voltage being higher than the first high-potential-side voltage; and a switch control circuit which generates the select signal by using a polarity reversal signal which designates polarity reversal timing of voltage applied to the electro-optical substance, wherein the first intermediate voltage is higher than the first low-potential-side voltage and lower than the first high-potential-side voltage, and wherein, when the common electrode voltage supply circuit changes the voltage of the common electrode from the first low-potential-side voltage to the first high-potential-side voltage, the common electrode voltage supply circuit supplies the first high-potential-side voltage or the first intermediate voltage to the common electrode in a first period, supplies the second high-potential-side voltage to the common electrode in a second period after the first period, and supplies the first high-potential-side voltage to the common electrode in a third period after the second period.

Another aspect of the present invention relates to a power supply circuit for supplying voltage to a common electrode which faces a pixel electrode through an electro-optical substance, the power supply circuit including:

a common electrode voltage supply circuit which supplies one of a first high-potential-side voltage, a first low-potential-side voltage, a second low-potential-side voltage, and a second intermediate voltage to the common electrode based on a select signal, the second low-potential-side voltage being lower than the first low-potential-side voltage; and a switch control circuit which generates the select signal by using a polarity reversal signal which designates polarity reversal timing of voltage applied to the electro-optical substance, wherein the second intermediate voltage is higher than the first low-potential-side voltage and lower than the first high-potential-side voltage, and wherein, when the common electrode voltage supply circuit changes the voltage of the common electrode from the first high-potential-side voltage to the first low-potential-side voltage, the common electrode voltage supply circuit supplies the first low-potential-side voltage or the second intermediate voltage to the common electrode in a fourth period, supplies the second low-potential-side voltage to the common electrode in a fifth period after the fourth period, and supplies the first low-potential-side voltage to the common electrode in a sixth period after the fifth period.

A further aspect of the present invention relates to a voltage supply method for supplying voltage to a common electrode which faces a pixel electrode through an electro-optical substance while changing the voltage from a first low-potential-side voltage to a first high-potential-side voltage, the voltage supply method including:

supplying a second high-potential-side voltage which is higher than the first high-potential-side voltage to the common electrode, to which the first low-potential-side voltage is supplied, instead of the first low-potential-side voltage; and supplying the first high-potential-side voltage to the common electrode after supplying the second high-potential-side voltage to the common electrode.

A still further aspect of the present invention relates to a voltage supply method for supplying voltage to a common electrode which faces a pixel electrode through an electro-optical substance while changing the voltage from a first high-potential-side voltage to a first low-potential-side voltage, the voltage supply method including:

supplying a second low-potential-side voltage which is lower than the first low-potential-side voltage to the common electrode, to which the first high-potential-side voltage is supplied, instead of the first high-potential-side voltage; and supplying the first low-potential-side voltage to the common electrode after supplying the second low-potential-side voltage to the common electrode.

DETAILED DESCRIPTION OF THE EMBODIMENT

Figure 1:
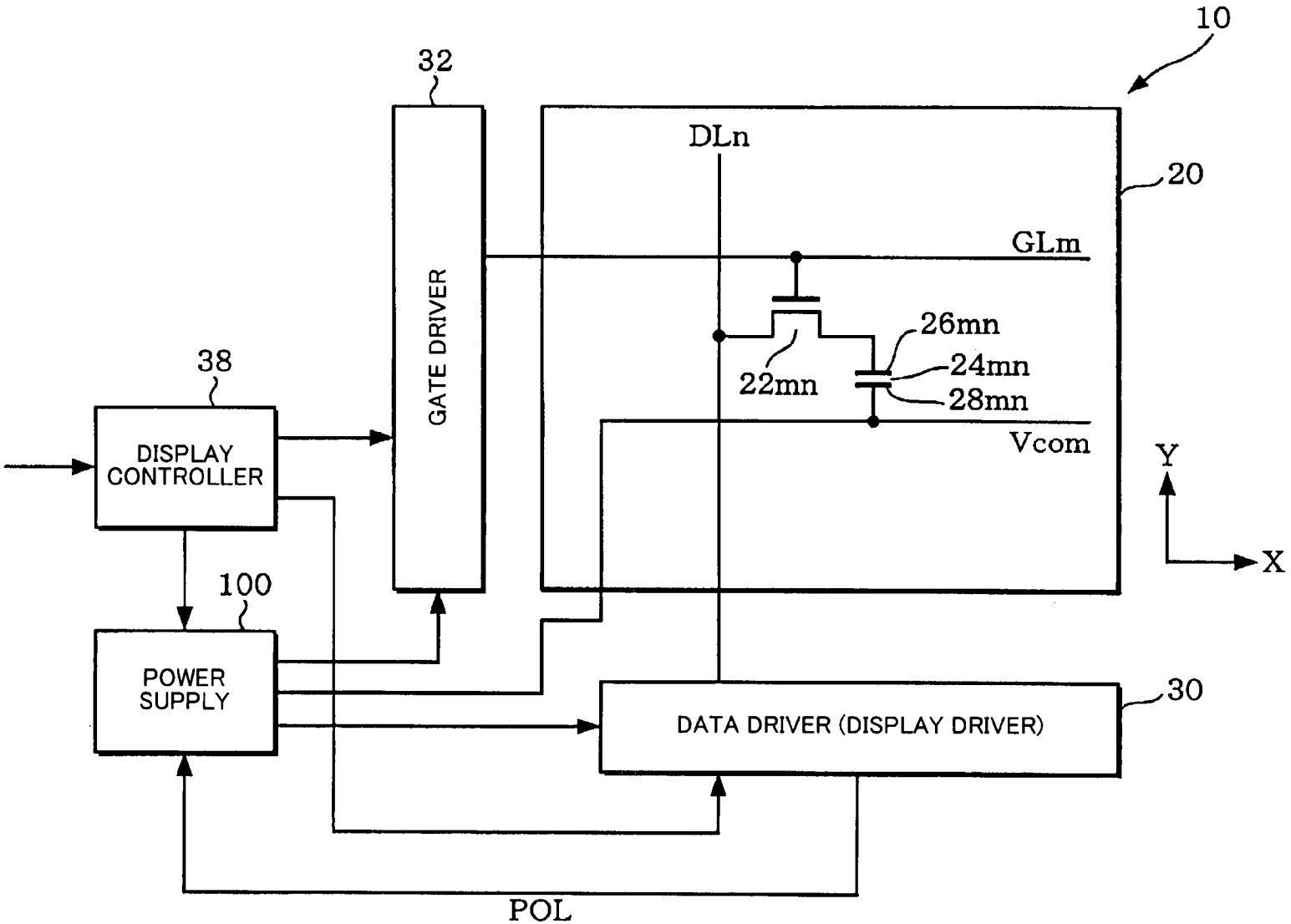
FIG. 1 shows a configuration example of an active matrix liquid crystal display device including a power supply circuit in an embodiment of the present invention.

Embodiments of the present invention are described below. Note that the embodiments described hereunder do not in any way limit the scope of the invention defined by the claims laid out herein. Note also that all of the elements described hereunder should not be taken as essential requirements to the present invention.

In the liquid crystal display device, a liquid crystal must be AC driven in order to prevent deterioration of the liquid crystal. Therefore, polarity reversal drive, in which the polarity of the voltage applied between the pixel electrode and the common electrode is reversed in units of one frame or one or a plurality of horizontal scanning periods, is performed in the liquid crystal display device. The polarity reversal drive is realized by changing the voltage supplied to the common electrode in synchronization with the polarity reversal timing, for example.

The polarity reversal drive is disclosed in Japanese Patent Application Laid-open No. 2002-149133, for example. Japanese Patent Application Laid-open No. 2002-149133 discloses technology which realizes the polarity reversal drive by changing the voltage of the common electrode. In more detail, in Japanese Patent Application Laid-open No. 2002-149133, the voltage of the common electrode and the voltage of the pixel electrode are set at the same value, and the voltage of the common electrode and the voltage of the pixel electrode are changed to the same potential in synchronization. This reduces consumption of excessive current which flows between the pixel electrode and the common electrode, whereby the voltage of the common electrode is changed at high speed without causing excessive current to flow for charging when changing the voltage.

In the case of performing the polarity reversal drive, a high-potential-side voltage and a low-potential-side voltage are supplied to the common electrode in synchronization with the polarity reversal timing as described in Japanese Patent Application Laid-open No. 2002-149133. The switching between the high-potential-side voltage and the low-potential-side voltage may be performed by using a switch circuit formed by a metal-oxide semiconductor (MOS) transistor.

However, the charge/discharge time of the common electrode connected with the drain of the MOS transistor is increased as the voltage applied between the source and drain of the MOS transistor is decreased. In the present situation in which the number of gray scales which can be displayed in the liquid crystal display device is increased and the voltage width for one gray scale is reduced, if the common electrode is insufficiently charged/discharged, the image quality deteriorates due to an error in the voltage of the common electrode.

Moreover, one horizontal scanning period is decreased as the display size of the liquid crystal display device is increased. Therefore, it is necessary to reduce the charge/discharge time of the common electrode accompanying the polarity reversal drive. The charge/discharge time of the common electrode is determined depending on the time constant which is the product of the parasitic capacitance C of the common electrode and the on-resistance R of the MOS transistor. Therefore, it is necessary to decrease at least one of the parasitic capacitance C and the resistance R as the display size is increased. Since the parasitic capacitance C of the common electrode cannot be decreased to a large extent, the on-resistance R of the MOS transistor may be decreased. In this case, although the resistance R can be decreased by increasing the channel width W of the MOS transistor, the scale of the switch circuit is increased. Moreover, self-power consumption of the on-resistance R of the MOS transistor is also increased.

According to the following embodiments, a power supply circuit which supplies voltage to the common electrode at high speed while reducing power consumption, a display driver, and a voltage supply method can be provided.

One embodiment of the present invention provides a power supply circuit for supplying voltage to a common electrode which faces a pixel electrode through an electro-optical substance, the power supply circuit including:

a common electrode voltage supply circuit which supplies one of a first high-potential-side voltage, a first low-potential-side voltage, a second high-potential-side voltage, and a first intermediate voltage to the common electrode based on a select signal, the second high-potential-side voltage being higher than the first high-potential-side voltage; and a switch control circuit which generates the select signal by using a polarity reversal signal which designates polarity reversal timing of voltage applied to the electro-optical substance, wherein the first intermediate voltage is higher than the first low-potential-side voltage and lower than the first high-potential-side voltage, and wherein, when the common electrode voltage supply circuit changes the voltage of the common electrode from the first low-potential-side voltage to the first high-potential-side voltage, the common electrode voltage supply circuit supplies the first high-potential-side voltage or the first intermediate voltage to the common electrode in a first period, supplies the second high-potential-side voltage to the common electrode in a second period after the first period, and supplies the first high-potential-side voltage to the common electrode in a third period after the second period.

In this embodiment of the present invention, the common electrode voltage supply circuit changes the voltage of the common electrode from the first low-potential-side voltage to the first high-potential-side voltage based on the polarity reversal signal which designates the polarity reversal timing of the voltage applied to the electro-optical substance. The common electrode voltage supply circuit supplies the second high-potential-side voltage which is higher than the first high-potential-side voltage to the common electrode in the second period designated based on the polarity reversal signal, and supplies the first high-potential-side voltage to the common electrode in the third period after the second period. This enables the voltage of the common electrode to be set at high speed. Therefore, deterioration of the image quality can be reduced even if the voltage width for one gray scale is decreased due to an increase in the number of gray scales which can be displayed. Moreover, even if one horizontal scanning period is reduced due to an increase in the display size, an electro-optical device including a pixel electrode and a common electrode can be driven by polarity reversal drive.

In this embodiment of the present invention, the common electrode voltage supply circuit supplies the first high-potential-side voltage or the first intermediate voltage to the common electrode in the first period before the second period. This reduces self-power consumption which is proportional to the square of the voltage, whereby power consumption can be reduced.

With this power supply circuit, the common electrode voltage supply circuit may supply one of the first high-potential-side voltage, the first low-potential-side voltage, the second high-potential-side voltage, the first intermediate voltage, a second low-potential-side voltage, and a second intermediate voltage to the common electrode based on the select signal, the second low-potential-side voltage being lower than the first low-potential-side voltage, the second intermediate voltage may be higher than the first low-potential-side voltage and lower than the first high-potential-side voltage, and when the common electrode voltage supply circuit changes the voltage of the common electrode from the first high-potential-side voltage to the first low-potential-side voltage, the common electrode voltage supply circuit may supply the first low-potential-side voltage or the second intermediate voltage to the common electrode in a fourth period, may supply the second low-potential-side voltage to the common electrode in a fifth period after the fourth period, and may supply the first low-potential-side voltage to the common electrode in a sixth period after the fifth period.

With this feature, the same effect as the above descriptions can be obtained in the case where the common electrode voltage supply circuit changes the voltage of the common electrode from the first high-potential-side voltage to the first low-potential-side voltage based on the polarity reversal signal which designates the polarity reversal timing of the voltage applied to the electro-optical substance. Specifically, the voltage of the common electrode can be set at high speed. Therefore, deterioration of the image quality can be reduced even if the voltage width for one gray scale is decreased due to an increase in the number of gray scales which can be displayed. Moreover, even if one horizontal scanning period is reduced due to an increase in the display size, an electro-optical device including a pixel electrode and a common electrode can be driven by polarity reversal drive.

With this feature, the common electrode voltage supply circuit supplies the first low-potential-side voltage or the second intermediate voltage to the common electrode in the fourth period before the fifth period. This reduces self-power consumption which is proportional to the square of the voltage, whereby power consumption can be reduced.

Another embodiment of the present invention provides a power supply circuit for supplying voltage to a common electrode which faces a pixel electrode through an electro-optical substance, the power supply circuit including:

a common electrode voltage supply circuit which supplies one of a first high-potential-side voltage, a first low-potential-side voltage, a second low-potential-side voltage, and a second intermediate voltage to the common electrode based on a select signal, the second low-potential-side voltage being lower than the first low-potential-side voltage; and a switch control circuit which generates the select signal by using a polarity reversal signal which designates polarity reversal timing of voltage applied to the electro-optical substance, wherein the second intermediate voltage is higher than the first low-potential-side voltage and lower than the first high-potential-side voltage, and wherein, when the common electrode voltage supply circuit changes the voltage of the common electrode from the first high-potential-side voltage to the first low-potential-side voltage, the common electrode voltage supply circuit supplies the first low-potential-side voltage or the second intermediate voltage to the common electrode in a fourth period, supplies the second low-potential-side voltage to the common electrode in a fifth period after the fourth period, and supplies the first low-potential-side voltage to the common electrode in a sixth period after the fifth period.

In this embodiment of the present invention, the common electrode voltage supply circuit changes the voltage of the common electrode from the first high-potential-side voltage to the first low-potential-side voltage based on the polarity reversal signal which designates the polarity reversal timing of the voltage applied to the electro-optical substance. The common electrode voltage supply circuit supplies the second low-potential-side voltage which is lower than the first low-potential-side voltage to the common electrode in the fifth period designated based on the polarity reversal signal, and supplies the first low-potential-side voltage to the common electrode in the sixth period after the fifth period. This enables the voltage of the common electrode to be set at high speed. Therefore, deterioration of the image quality can be reduced even if the voltage width for one gray scale is decreased due to an increase in the number of gray scales which can be displayed. Moreover, even if one horizontal scanning period is reduced due to an increase in the display size, an electro-optical device including a pixel electrode and a common electrode can be driven by polarity reversal drive.

In this embodiment of the present invention, the common electrode voltage supply circuit supplies the first low-potential-side voltage or the second intermediate voltage to the common electrode in the fourth period before the fifth period. This reduces self-power consumption which is proportional to the square of the voltage, whereby power consumption can be reduced.

Any of these power supply circuits may include first and second period setting registers for setting the first and second periods, respectively, and the switch control circuit may designate the first and second periods based on a change point of the polarity reversal signal by using the select signal having a pulse width corresponding to a value set in each of the first and second period setting registers.

Any of these power supply circuits may include fourth and fifth period setting registers for setting the fourth and fifth periods, respectively, and the switch control circuit may designate the fourth and fifth periods based on a change point of the polarity reversal signal by using the select signal having a pulse width corresponding to a value set in each of the fourth and fifth period setting registers.

According to these embodiments of the present invention, the first and second periods can be optimized by changing the values set in the first and second period setting registers corresponding to the display size or characteristics of an electro-optical device including a pixel electrode and a common electrode. Specifically, highly accurate voltage supply and reduction of power consumption of the electro-optical device can be easily realized by optimizing supply of voltage to the pixel electrode.

According to these embodiments of the present invention, the fourth and fifth periods can be optimized by changing the values set in the fourth and fifth period setting registers according to the display size or characteristics of an electro-optical device including a pixel electrode and a common electrode. Specifically, highly accurate voltage supply and reduction of power consumption of the electro-optical device can be easily realized by optimizing supply of voltage to the pixel electrode.

With any of these power supply circuits, the common electrode voltage supply circuit may include a voltage-follower-connected first operational amplifier which generates the first high-potential-side voltage, a given voltage being supplied to an input of the first operational amplifier, and the second high-potential-side voltage may be a high-potential-side power supply voltage of the first operational amplifier.

With any of these power supply circuits, the common electrode voltage supply circuit may include a voltage-follower-connected second operational amplifier which generates the second high-potential-side voltage, a given voltage being supplied to an input of the second operational amplifier, and the second low-potential-side voltage may be a low-potential-side power supply voltage of the second operational amplifier.

According to these embodiments of the present invention, since the first high-potential-side voltage is supplied to the common electrode by the voltage-follower-connected first operational amplifier, or the first low-potential-side voltage is supplied to the common electrode by the voltage-follower-connected second operational amplifier, unnecessary power consumption for supplying other voltages for which highly accurate regulation of the voltage level is unnecessary can be reduced. Moreover, power consumption can be further reduced by providing the first and second operational amplifiers in comparison with the case of using the operational amplifier between the first high-potential-side voltage and the first low-potential-side voltage.

A further embodiment of the present invention provides a display driver including any of the above power supply circuits which supplies voltage to the common electrode; and a driver circuit which drives a data line connected with the pixel electrode through a switching device based on display data.

According to this embodiment of the present invention, the mounting size of an electro-optical device including a pixel electrode and a common electrode can be reduced, whereby a display driver which reduces power consumption and prevents deterioration of the image quality can be provided.

A still further embodiment of the present invention provides a voltage supply method for supplying voltage to a common electrode which faces a pixel electrode through an electro-optical substance while changing the voltage from a first low-potential-side voltage to a first high-potential-side voltage, the voltage supply method including:

supplying a second high-potential-side voltage which is higher than the first high-potential-side voltage to the common electrode, to which the first low-potential-side voltage is supplied, instead of the first low-potential-side voltage; and supplying the first high-potential-side voltage to the common electrode after supplying the second high-potential-side voltage to the common electrode.

This voltage supply method may include supplying one of the first high-potential-side voltage and a first intermediate voltage, which is lower than the first high-potential-side voltage and higher than the first low-potential-side voltage, to the common electrode before supplying the second high-potential-side voltage to the common electrode.

A yet further embodiment of the present invention provides a voltage supply method for supplying voltage to a common electrode which faces a pixel electrode through an electro-optical substance while changing the voltage from a first high-potential-side voltage to a first low-potential-side voltage, the voltage supply method including:

supplying a second low-potential-side voltage which is lower than the first low-potential-side voltage to the common electrode, to which the first high-potential-side voltage is supplied, instead of the first high-potential-side voltage; and supplying the first low-potential-side voltage to the common electrode after supplying the second low-potential-side voltage to the common electrode.

This voltage supply method may include supplying one of the first low-potential-side voltage and a second intermediate voltage, which is higher than the first low-potential-side voltage and lower than the first high-potential-side voltage, to the common electrode before supplying the second low-potential-side voltage to the common electrode.

The embodiments of the present invention are described below in detail with reference to the drawings.

1. Liquid Crystal Display Device

FIG. 1 shows an outline of a configuration of an active matrix liquid crystal display device including a power supply circuit in the present embodiment.

The liquid crystal display device 10 includes a liquid crystal display panel 20 (display panel in a broad sense).

The liquid crystal display panel 20 is formed on a glass substrate, for example. A plurality of scanning lines (gate lines) GL1 to GLM (M is an integer of two or more), arranged in the Y direction and extending in the X direction, and a plurality of data lines (source lines) DL1 to DLN (N is an integer of two or more), arranged in the X direction and extending in the Y direction, are disposed on the glass substrate. A pixel region (pixel) is provided corresponding to the intersecting point of the scanning line GLm ($1 \leqq m \leqq M$, m is an integer; hereinafter the same) and the data line DLn ($1 \leqq n \leqq N$, n is an integer; hereinafter the same). A thin-film transistor 22 mn (hereinafter abbreviated as "TFT") is disposed in the pixel region.

A gate of the TFT 22 mn is connected with the scanning line GLm. A source of the TFT 22 mn is connected with the data line DLn. A drain of the TFT 22 mn is connected with a pixel electrode 26 mn. A liquid crystal is sealed between the pixel electrode 26 mn and a common electrode 28 mn which faces the pixel electrode 26 mn, whereby a liquid crystal capacitor 24 mn (liquid crystal element in a broad sense) is formed. The transmissivity of the pixel changes corresponding to the voltage applied between the pixel electrode 26 mn and the common electrode 28 mn. A common electrode voltage Vcom is supplied to the common electrode 28 mn.

The liquid crystal display panel 20 is formed by attaching a first substrate on which the pixel electrode and the TFT are formed to a second substrate on which the common electrode is formed, and sealing a liquid crystal as an electro-optical substance between the substrates, for example.

The liquid crystal display device 10 includes a display driver 30 (data driver in a narrow sense). The display driver 30 drives the data lines DL1 to DLN of the liquid crystal display panel 20 based on display data.

The liquid crystal display device 10 may include a gate driver 32. The gate driver 32 scans the scanning lines GL1 to GLM of the liquid crystal display panel 20 within one vertical scanning period.

The liquid crystal display device 10 includes a power supply circuit 100. The power supply circuit 100 generates voltage necessary for driving the data lines, and supplies the voltage to the display driver 30. The power supply circuit 100 generates power supply voltages VDDH and VSSH necessary for the display driver 30 to drive the data lines and voltages for the logic section of the display driver 30, for example.

The power supply circuit 100 generates voltage necessary for scanning the scanning lines, and supplies the voltage to the gate driver 32.

The power supply circuit 100 generates the common electrode voltage Vcom. The power supply circuit 100 outputs the common electrode voltage Vcom, which is periodically set at a first high-potential-side voltage VCOMH and a first low-potential-side voltage VCOML in synchronization with the timing of a polarity reversal signal POL generated by the display driver 30, to the common electrode of the liquid crystal display panel 20.

The liquid crystal display device 10 may include a display controller 38. The display controller 38 controls the display driver 30, the gate driver 32, and the power supply circuit 100 according to the contents set by a host such as a central processing unit (hereinafter abbreviated as "CPU") (not shown). The display controller 38 provides an operation mode setting and a vertical synchronization signal or a horizontal synchronization signal generated therein to the display driver 30 and the gate driver 32, for example.

In FIG. 1, the liquid crystal display device 10 includes the power supply circuit 100 or the display controller 38. However, at least one of the power supply circuit 100 and the display controller 38 may be provided outside the liquid crystal display device 10. The liquid crystal display device 10 may include the host.

The display driver 30 may include at least one of the gate driver 32 and the power supply circuit 100.

Figure 2:
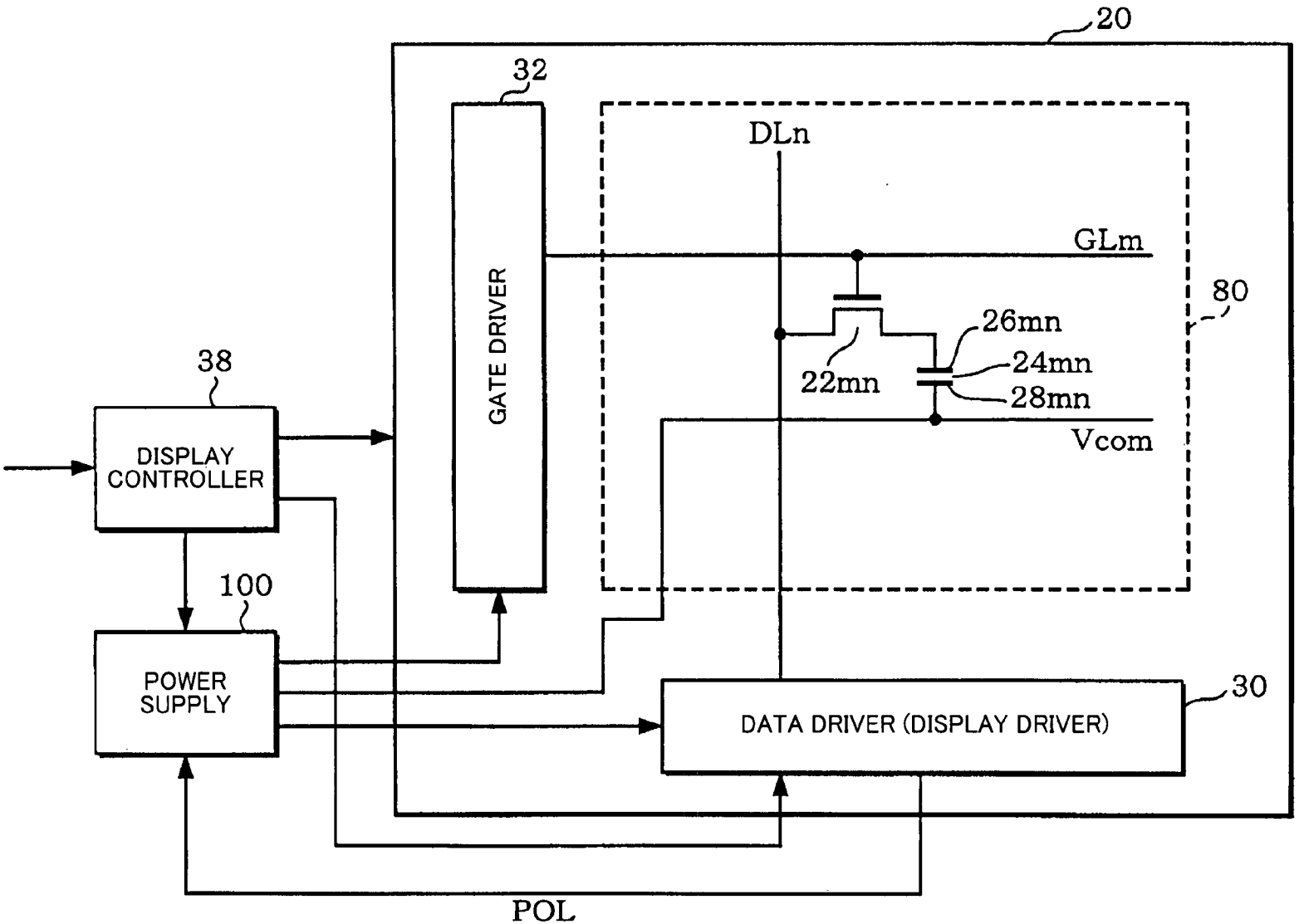
FIG. 2 shows another configuration example of an active matrix liquid crystal display device including a power supply circuit in an embodiment of the present invention.

Some or all of the display driver 30, the gate driver 32, the display controller 38, and the power supply circuit 100 may be formed on the liquid crystal display panel 20. In FIG. 2, the display driver 30 and the gate driver 32 are formed on the liquid crystal display panel 20. As described above, the liquid crystal display panel 20 may be configured to include a plurality of data lines, a plurality of scanning lines, a plurality of switching devices, each of the switching devices being connected with one of the scanning lines and one of the data lines, and a display driver which drives the data lines. The pixels are formed in a pixel formation region 80 of the liquid crystal display panel 20.

2. Power Supply Circuit

The power supply circuit supplies voltage to the common electrode which faces the pixel electrode through a liquid crystal as an electro-optical substance. The power supply circuit supplies the high-potential-side voltage VCOMH or the low-potential-side voltage VCOML to the common electrode in synchronization with the polarity reversal timing. The power supply circuit may include a switch circuit which selectively supplies the high-potential-side voltage VCOMH or the low-potential-side voltage VCOML to the common electrode. The switch circuit is formed by a MOS transistor.

Figure 3:
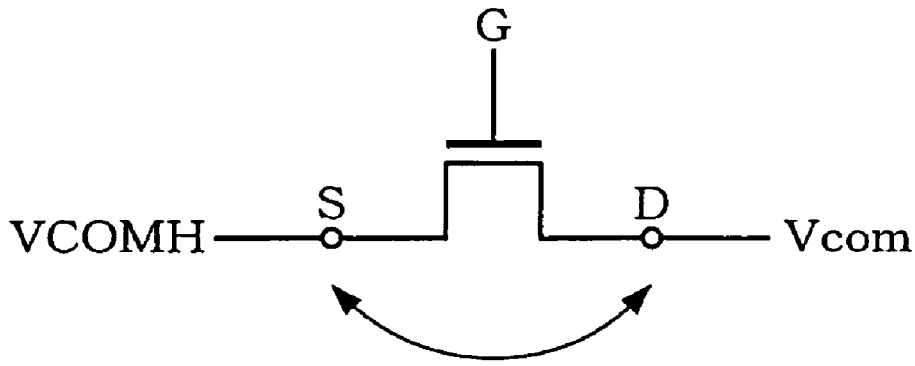
FIG. 3 describes an example of a MOS transistor which makes up a switch circuit.

FIG. 3 shows an example of a MOS transistor which makes up the switch circuit.

The common electrode is connected with a drain (D) of the MOS transistor, and the high-potential-side voltage VCOMH is connected with a source (S) of the MOS transistor. The common electrode is set at the high-potential-side voltage VCOMH based on a signal supplied to a gate (G) of the MOS transistor.

Figure 4:
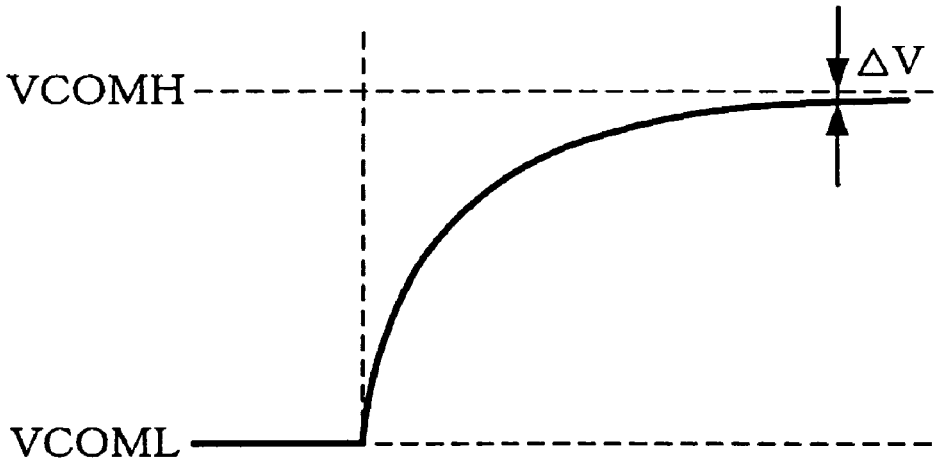
FIG. 4 is a schematic diagram of an example of a change in potential of a common electrode connected with a MOS transistor.

FIG. 4 shows a schematic diagram of an example of a change in potential of the common electrode.

Generally, the charge/discharge time of the common electrode connected with the drain of the MOS transistor is increased as the voltage applied between the source and drain of the MOS transistor is decreased. Therefore, it takes time until the voltage of the common electrode is set at the high-potential-side voltage, as shown in FIG. 4. Therefore, the image quality deteriorates due to the difference $\Delta V$ between the high-potential-side voltage at which the common electrode should be set and the voltage of the common electrode. In particular, deterioration of the image quality occurs significantly in the case where the voltage width for one gray scale is decreased due to an increase in the number of gray scales which can be displayed in the liquid crystal display device. Moreover, it becomes difficult to perform polarity reversal drive in the case where one horizontal scanning period is reduced due to an increase in the display size of the liquid crystal display device.

FIG. 4 illustrates the case where the voltage of the common electrode is changed from the low-potential-side voltage to the high-potential-side voltage. However, the same description also applies to the case where the voltage of the common electrode is changed from the high-potential-side voltage to the low-potential-side voltage.

The power supply circuit in the present embodiment sets the voltage of the common electrode with high accuracy and reduces power consumption by supplying voltage to the common electrode as described below.

Figure 5:
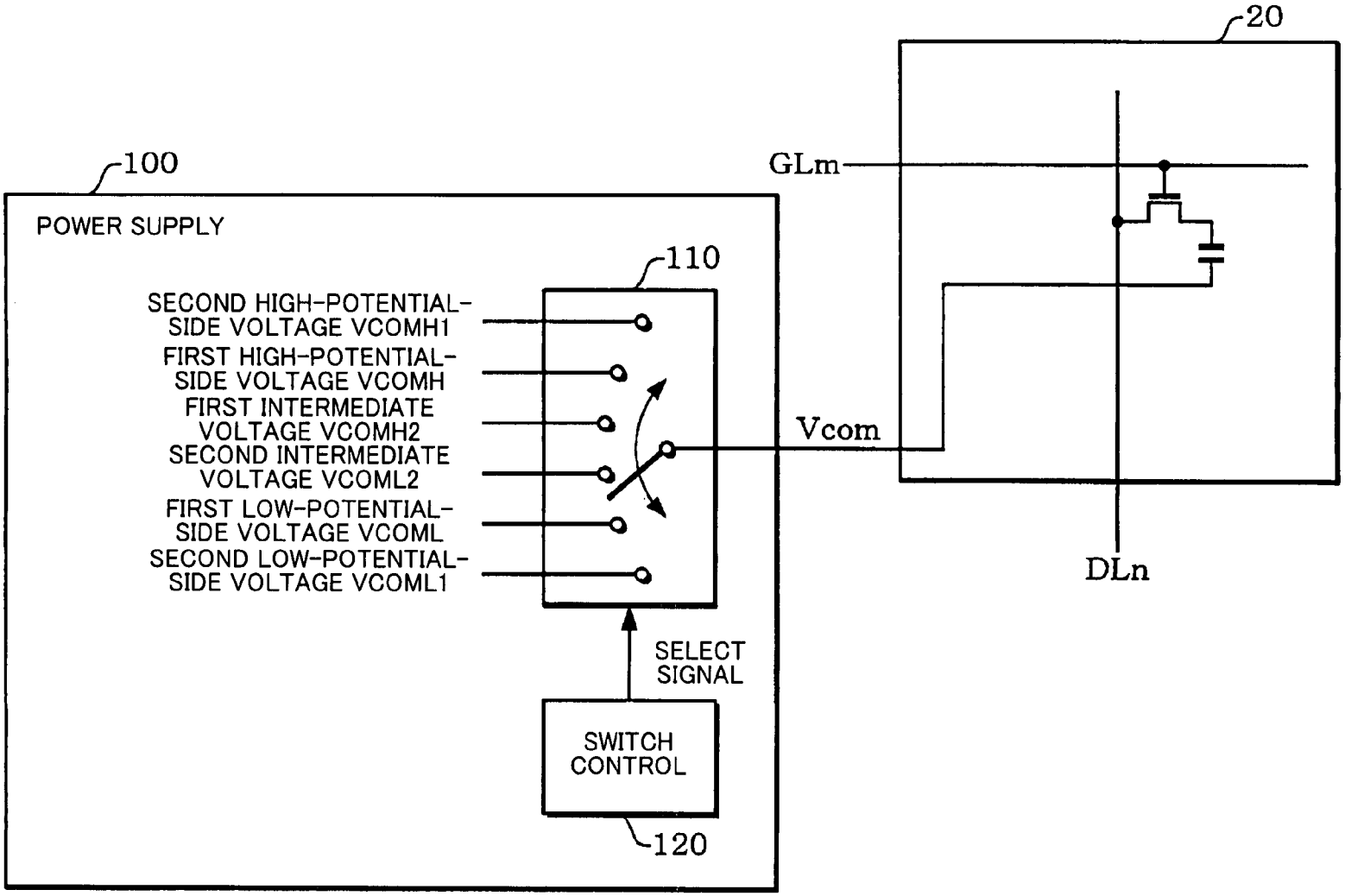
FIG. 5 shows an outline of a configuration of a power supply circuit in an embodiment of the present invention.

FIG. 5 shows an outline of a configuration of the power supply circuit in the present embodiment. In FIG. 5, sections the same as the sections of the liquid crystal display device shown in FIGS. 1 and 2 are denoted by the same symbols. Description of these sections is appropriately omitted.

The power supply circuit 100 includes a common electrode voltage supply circuit 110 and a switch control circuit 120. The common electrode voltage supply circuit 110 supplies one of a plurality of voltages to the common electrode based on a select signal. The switch control circuit generates the select signal by using the polarity reversal signal POL.

The power supply circuit 100 sets the voltage of the common electrode at the first high-potential-side voltage VCOMH or the first low-potential-side voltage VCOML. Therefore, the first high-potential-side voltage VCOMH and the first low-potential-side voltage VCOML are supplied to the common electrode voltage supply circuit 110.

When the common electrode voltage supply circuit 110 changes the voltage of the common electrode from the first low-potential-side voltage VCOML to the first high-potential-side voltage VCOMH, the common electrode voltage supply circuit 110 changes the voltage of the common electrode to the first high-potential-side voltage VCOMH by supplying other voltages to the common electrode based on the select signal. Therefore, a second high-potential-side voltage VCOMH1 which is higher than the first high-potential-side voltage VCOMH and a first intermediate voltage VCOMH2 are supplied to the common electrode voltage supply circuit 110.

When the common electrode voltage supply circuit 110 changes the voltage of the common electrode from the first high-potential-side voltage VCOMH to the first low-potential-side voltage VCOML, the common electrode voltage supply circuit 110 changes the voltage of the common electrode to the first low-potential-side voltage VCOML by supplying other voltages to the common electrode based on the select signal. Therefore, a second low-potential-side voltage VCOML1 which is lower than the first low-potential-side voltage VCOML and a second intermediate voltage VCOML2 are supplied to the common electrode voltage supply circuit 110.

Figure 6:
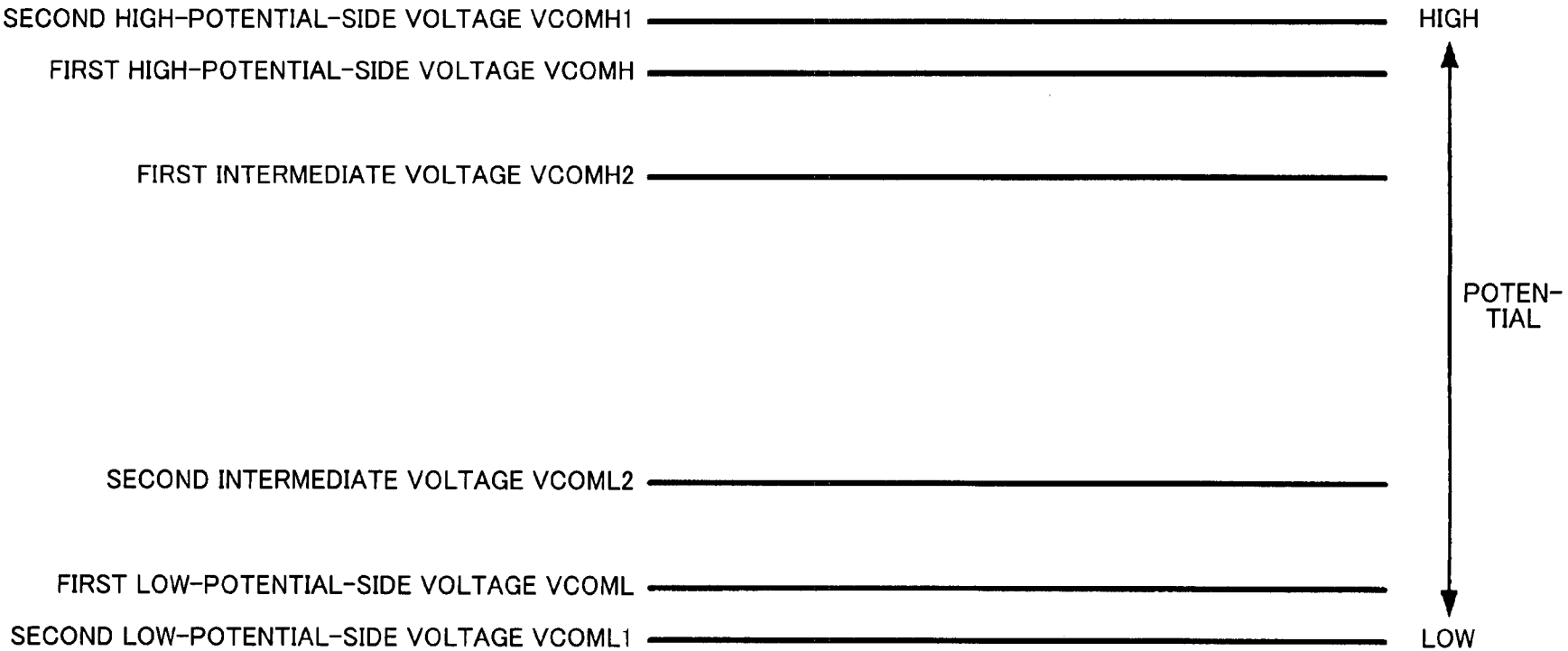
FIG. 6 describes a potential relationship among a plurality of voltages supplied to a common electrode voltage supply circuit.

FIG. 6 shows an explanatory diagram of a potential relationship among the voltages supplied to the common electrode voltage supply circuit 110. The first high-potential-side voltage VCOMH or the first low-potential-side voltage VCOML is finally supplied to the common electrode.

The second high-potential-side voltage VCOMH1 is a voltage higher than the first high-potential-side voltage VCOMH.

The first intermediate voltage VCOMH2 is a voltage lower than the first high-potential-side voltage VCOMH but higher than the first low-potential-side voltage VCOML.

The second low-potential-side voltage VCOML1 is a voltage lower than the first low-potential-side voltage VCOML.

The second intermediate voltage VCOML2 is a voltage lower than the first high-potential-side voltage VCOMH but higher than the first low-potential-side voltage VCOML. The second intermediate voltage VCOML2 may be either higher or lower than the first intermediate voltage VCOMH2.

The common electrode voltage supply circuit 110 does not necessarily switch the six voltages shown in FIG. 5. The common electrode voltage supply circuit 110 may switch only some of these voltages.

Figure 7:
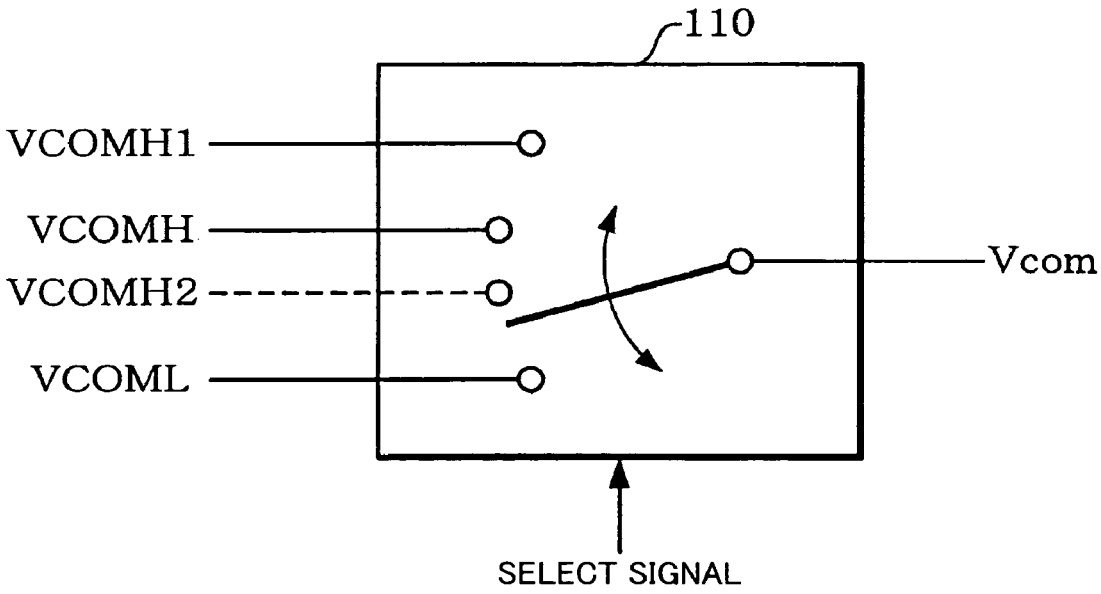
FIG. 7 shows an example of a configuration of a common electrode voltage supply circuit.

FIG. 7 shows an example of a configuration of the common electrode voltage supply circuit 110.

The common electrode voltage supply circuit 110 supplies one of the first high-potential-side voltage VCOMH1, the first low-potential-side voltage VCOML, the second high-potential-side voltage VCOMH1, and the first intermediate voltage VCOMH2 to the common electrode based on the select signal. The select signal is generated by the switch control circuit 120.

Figure 8:
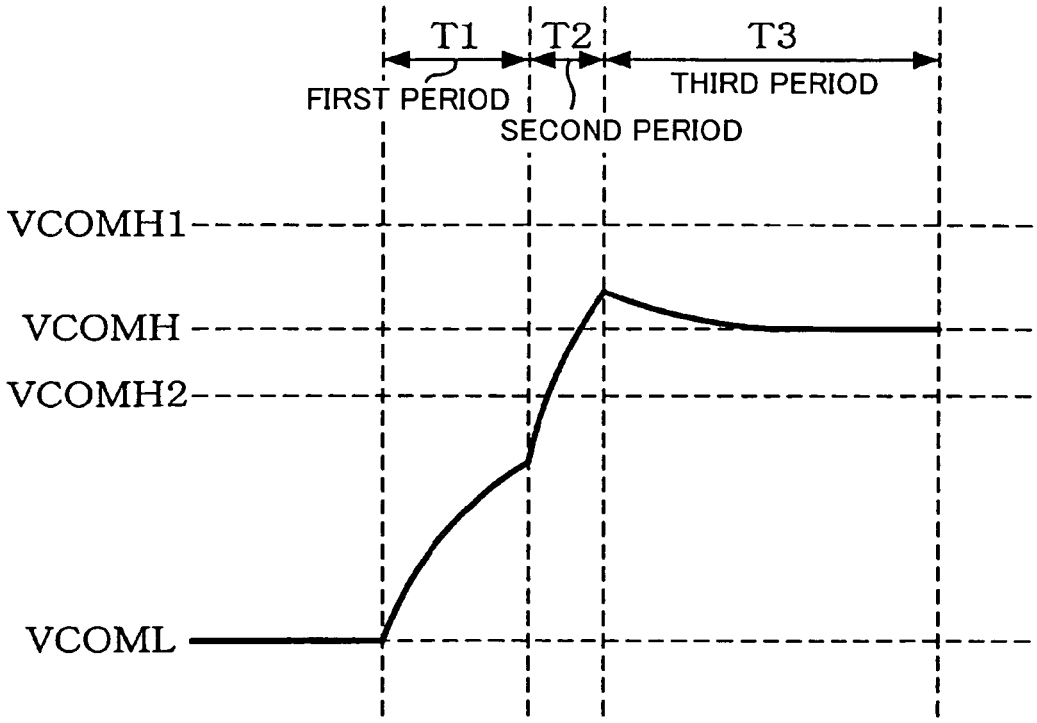
FIG. 8 describes an example of a change in potential of a common electrode by the common electrode voltage supply circuit shown in FIG. 7.

FIG. 8 shows an example of a change in potential of the common electrode by the common electrode voltage supply circuit 110 shown in FIG. 7.

Specifically, when the common electrode voltage supply circuit 110 changes the voltage of the common electrode from the first low-potential-side voltage VCOML to the first high-potential-side voltage VCOMH, the common electrode voltage supply circuit 110 supplies voltage to the common electrode in each of first to third periods T1 to T3 based on the select signal generated by the switch control circuit. The common electrode voltage supply circuit 110 supplies the first intermediate voltage VCOMH2 to the common electrode in the first period T1. The common electrode voltage supply circuit 110 supplies the second high-potential-side voltage VCOMH1 to the common electrode in the second period T2 after the first period T1. The common electrode voltage supply circuit 110 supplies the first high-potential-side voltage VCOMH to the common electrode in the third period T3 after the second period T2.

The voltage of the common electrode can be set at the first high-potential-side voltage VCOMH at high speed differing from FIG. 4 by charging/discharging the common electrode which should be set at the first high-potential-side voltage VCOMH toward the second high-potential-side voltage VCOMH1 which is higher than the first high-potential-side voltage VCOMH.

The first intermediate voltage VCOMH2 is supplied to the common electrode in the first period T1 before supplying the second high-potential-side voltage VCOMH1 to the common electrode. If the resistance of the MOS transistor which makes up the switch circuit is denoted by R, and the voltage between the source and drain of the MOS transistor is denoted by V, self-power consumption of the MOS transistor is approximately expressed by $V^2/R$. Specifically, self-power consumption of the switch circuit formed by the MOS transistor is proportional to the square of the voltage V. Therefore, self-power consumption of the switch circuit can be reduced by causing the voltage of the common electrode to approach the first intermediate voltage VCOMH2 after the first period T1 in comparison with the case of directly increasing the potential of the voltage of the common electrode from the first low-potential-side voltage VCOML to the first high-potential-side voltage VCOMH, whereby power consumption can be reduced.

FIGS. 7 and 8 illustrate the case where the common electrode voltage supply circuit 110 supplies the first intermediate voltage to the common electrode in the first period T1. However, the present invention is not limited thereto. The common electrode voltage supply circuit 110 may supply the first high-potential side voltage VCOMH to the common electrode in the first period T1, for example. In this case, a configuration in which the first intermediate voltage VCOMH2 is omitted in FIG. 7 can be employed.

Figure 9:
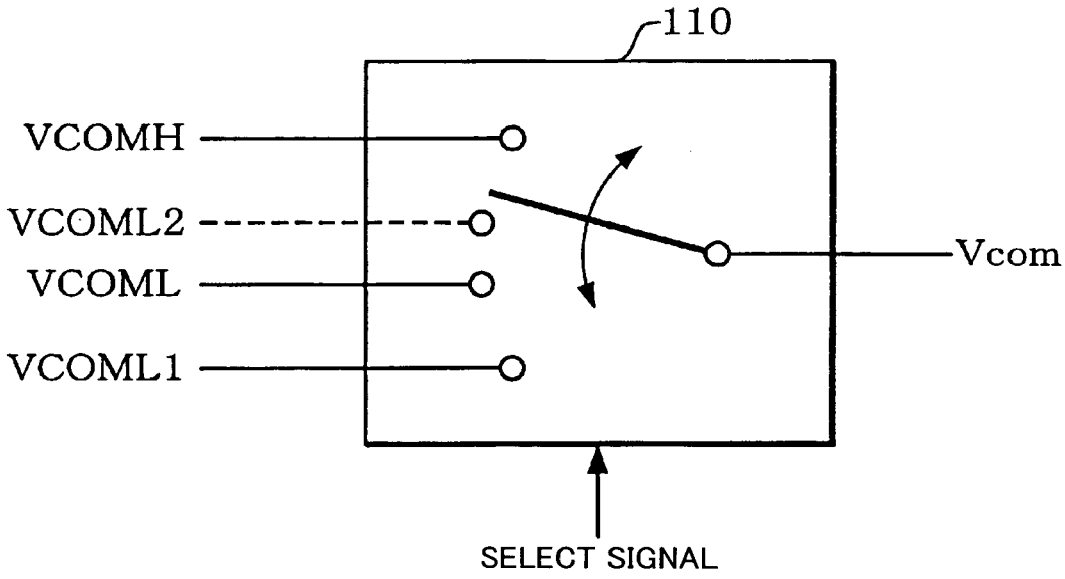
FIG. 9 shows another example of a configuration of a common electrode voltage supply circuit.

FIG. 9 shows another example of a configuration of the common electrode voltage supply circuit 110.

The common electrode voltage supply circuit 110 supplies one of the first high-potential-side voltage VCOMH1, the first low-potential-side voltage VCOML, the second low-potential-side voltage VCOML1, and the second intermediate voltage VCOML2 to the common electrode based on the select signal.

Figure 10:
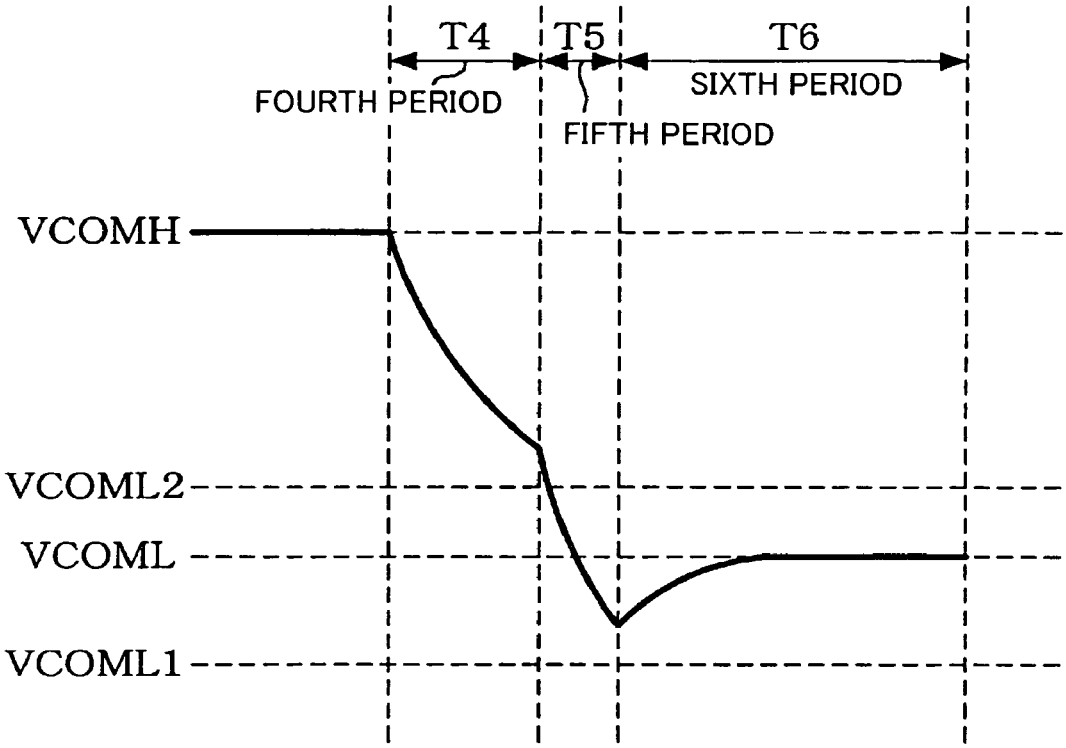
FIG. 10 describes an example of a change in potential of a common electrode by the common electrode voltage supply circuit shown in FIG. 9.

FIG. 10 shows an example of a change in potential of the common electrode supplied by the common electrode voltage supply circuit 110 shown in FIG. 9.

Specifically, when the common electrode voltage supply circuit 110 changes the voltage of the common electrode from the first high-potential-side voltage VCOMH to the first low-potential-side voltage VCOML, the common electrode voltage supply circuit 110 supplies voltage to the common electrode in each of fourth to sixth periods T4 to T6 based on the select signal generated by the switch control circuit. The common electrode voltage supply circuit 110 supplies the second intermediate voltage VCOML2 to the common electrode in the fourth period T4. The common electrode voltage supply circuit 110 supplies the second low-potential-side voltage VCOML1 to the common electrode in the fifth period T5 after the fourth period T4. The common electrode voltage supply circuit 110 supplies the first low-potential-side voltage VCOML to the common electrode in the sixth period T6 after the fifth period T5.

The voltage of the common electrode can be set at the first low-potential-side voltage VCOML at high speed by charging/discharging the common electrode which should be set at the first low-potential-side voltage VCOML toward the second low-potential-side voltage VCOML1 which is lower than the first low-potential-side voltage VCOML.

The second intermediate voltage VCOML2 is supplied to the common electrode in the fourth period T4 before supplying the second low-potential-side voltage VCOML1 to the common electrode. Therefore, self-power consumption of the switch circuit can be reduced by causing the voltage of the common electrode to approach the second intermediate voltage VCOML2 after the fourth period T4 in comparison with the case of directly decreasing the voltage of the common electrode from the first high-potential-side voltage VCOMH to the first low-potential-side voltage VCOML, whereby power consumption can be reduced.

FIGS. 9 and 10 illustrate the case where the common electrode voltage supply circuit 110 supplies the second intermediate voltage to the common electrode in the fourth period T4. However, the present invention is not limited thereto. The common electrode voltage supply circuit 110 may supply the first low-potential-side voltage VCOML to the common electrode in the fourth period T4, for example. In this case, a configuration in which the second intermediate voltage VCOML2 is omitted in FIG. 9 can be employed.

A configuration example of the power supply circuit 100 which controls supply of voltage to the common electrode is described below.

Figure 11:
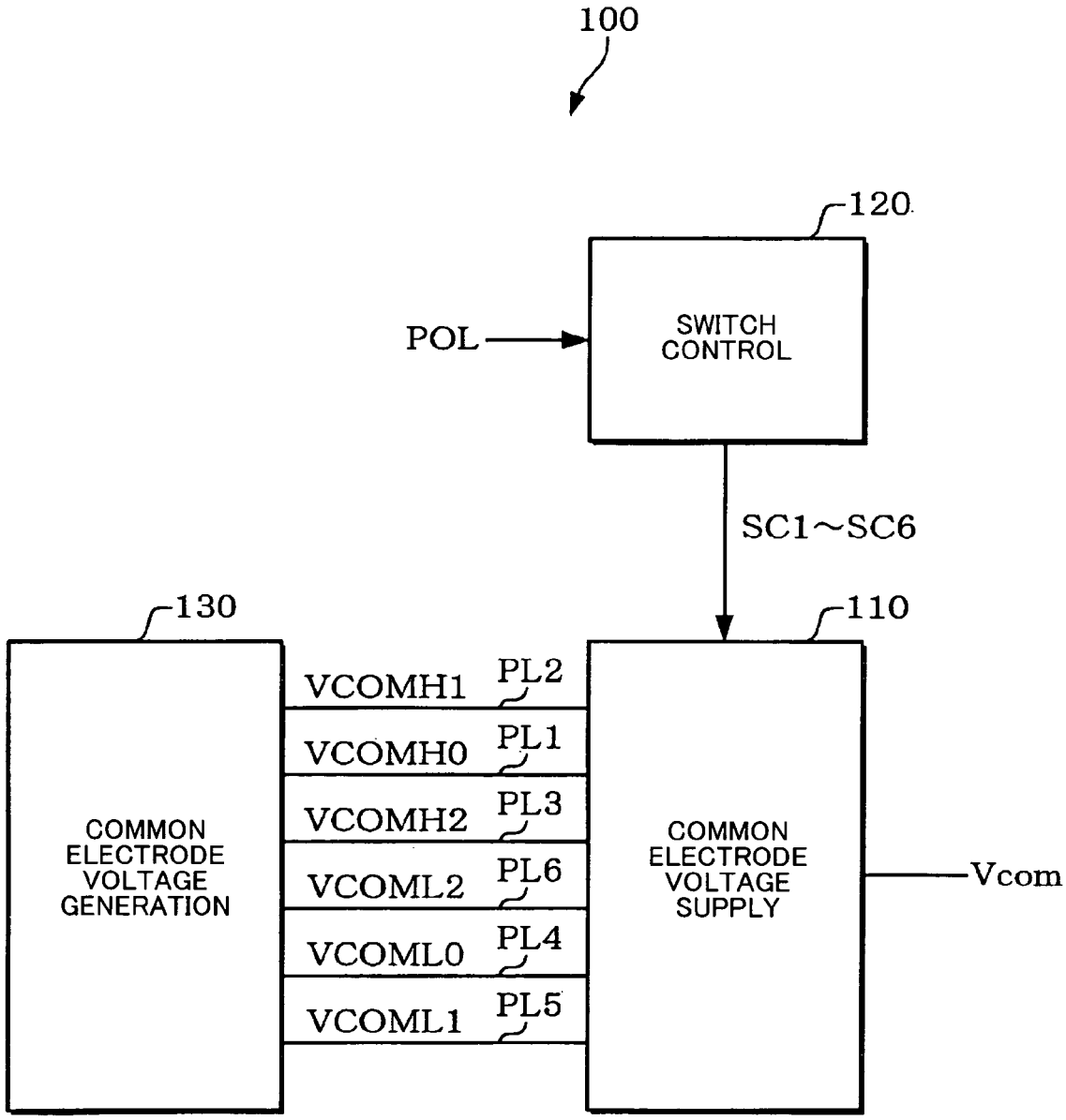
FIG. 11 is a block diagram of an outline of a configuration of a power supply circuit in an embodiment of the present invention.

FIG. 11 shows a block diagram of an outline of a configuration of the power supply circuit 100 in the present embodiment. In FIG. 11, sections the same as the sections of the power supply circuit 100 shown in FIG. 5 are denoted by the same symbols. Description of these sections is appropriately omitted.

The power supply circuit 100 includes the common electrode voltage supply circuit 110, the switch control circuit 120, and a common electrode voltage generation circuit 130.

The switch control circuit 120 generates the select signals SC1 to SC6 using the polarity reversal signal POL. The polarity reversal signal POL is a signal which designates the polarity reversal timing of the voltage applied to the liquid crystal (electro-optical substance). The polarity reversal signal POL is generated by the display driver 30, for example.

The common electrode voltage supply circuit 110 drives the common electrode using voltage of one of first to sixth power supply lines PL1 to PL6 based on the select signals SC1 to SC6. A high-potential-side voltage VCOMH0 for generating the first high-potential-side voltage VCOMH is supplied to the first power supply line PL1. The second high-potential-side voltage VCOMH1 is supplied to the second power supply line PL2. The first intermediate voltage VCOMH2 is supplied to the third power supply line PL3. A low-potential-side voltage VCOML0 for generating the first low-potential-side voltage VCOML is supplied to the fourth power supply line PL4. The second low-potential-side voltage VCOML1 is supplied to the fifth power supply line PL5. The second intermediate voltage VCOML2 is supplied to the sixth power supply line PL6.

The first to sixth power supply lines PL1 to PL6 are connected with the common electrode voltage generation circuit 130. The common electrode voltage generation circuit 130 generates the high-potential-side voltage VCOMH0, the second high-potential-side voltage VCOMH1, the first intermediate voltage VCOMH2, the low-potential-side voltage VCOML0, the second low-potential-side voltage VCOML1, and the second intermediate voltage VCOMH2.

Figure 12:
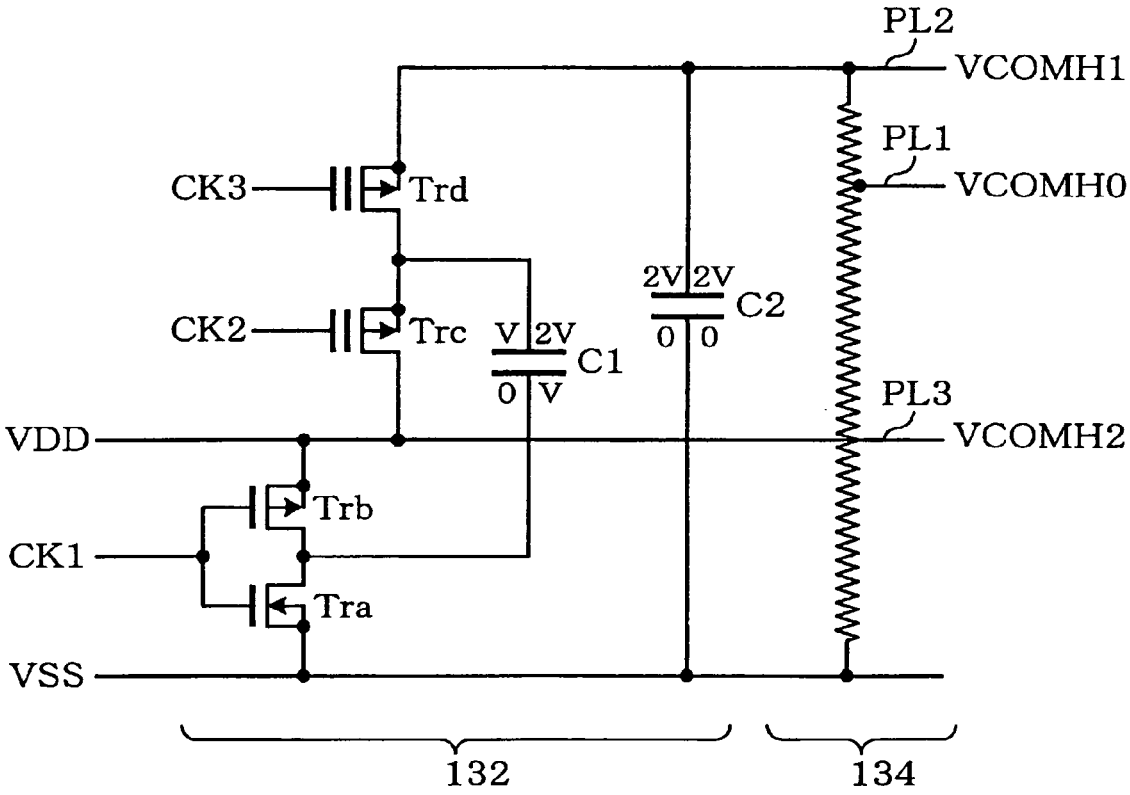
FIG. 12 is a circuit diagram of a configuration example of a part of a common electrode voltage generation circuit.

FIG. 12 shows a circuit diagram of a part of a configuration example of the common electrode voltage generation circuit 130. FIG. 12 shows an example of a circuit diagram of a part which generates the high-potential-side voltage VCOMH0, the second high-potential-side voltage VCOMH1, and the first intermediate voltage VCOMH2. However, a part of the circuit which generates the low-potential-side voltage VCOML0, the second low-potential-side voltage VCOML1, and the second intermediate voltage VCOML2 may be configured in the same manner as described below.

A part of the common electrode voltage generation circuit 130 shown in FIG. 12 includes a voltage booster circuit 132 and a voltage generation circuit 134.

The voltage booster circuit 132 is a voltage-doubler charge-pump circuit. The voltage booster circuit 132 outputs the voltage obtained by doubling the voltage V between the system power supply voltage VDD and the system ground power supply voltage VSS between the first power supply line PL2 and the system ground power supply voltage VSS.

Figure 13:
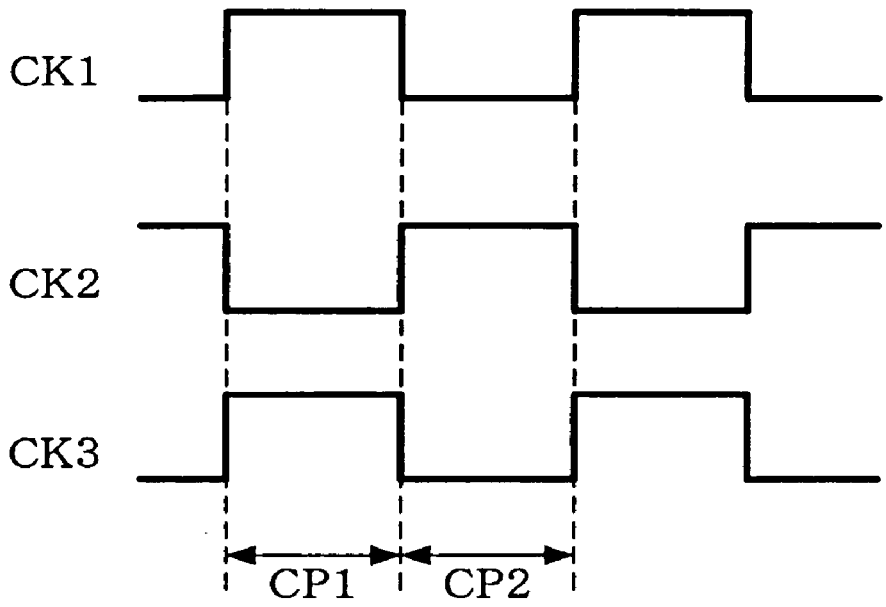
FIG. 13 is a timing diagram showing an example of timing of a boost clock signal.

The voltage booster circuit 132 performs a charge-pump operation based on boost clock signals CK1 to CK3 as shown in FIG. 13.

Specifically, in a first charge-pump period CP1 shown in FIG. 13, one end of a capacitor C1 is set at the system ground power supply voltage VSS through a transistor Tra which is in an ON state. The other end of the capacitor C1 is set at the system power supply voltage VDD through a transistor Trc which is in an ON state. Therefore, the voltage V is applied across the capacitor C1. A transistor Trd is in an OFF state in the first charge-pump period CP1.

In the second charge-pump period CP2, one end of the capacitor C1 is set at the system power supply voltage VDD through a transistor Trb which is in an ON state. The other end of the capacitor C1 is electrically connected with the second power supply line PL2 through the transistor Trd which is in an ON state. Therefore, the other end of the capacitor C1, in which electric charges have been stored in the first charge-pump period CP1, is set at 2 V with respect to the system ground power supply voltage VSS.

Electric charges retained based on the voltage boosted by the charge-pump operation are stored in the capacitor C2. This enables the voltage boosted with respect to the system ground power supply voltage VSS to be output to the second power supply line PL2 as the second high-potential-side voltage VCOMH1.

The voltage generation circuit 134 outputs the high-potential-side voltage VCOMH0 obtained by dividing the voltage between the second power supply line PL2 and the system ground power supply voltage VSS.

A voltage at an intermediate potential when the voltage is boosted by the voltage booster circuit 132 is output to the third power supply line PL3. In FIG. 12, the system power supply voltage VDD is output to the third power supply line PL3.

FIG. 12 illustrate the case where the voltage booster circuit 132 doubles the voltage. However, the voltage boost ratio is not limited. The same description also applies to the case where the voltage booster circuit 132 boosts the voltage three time, four times, or the like.

Figure 14:
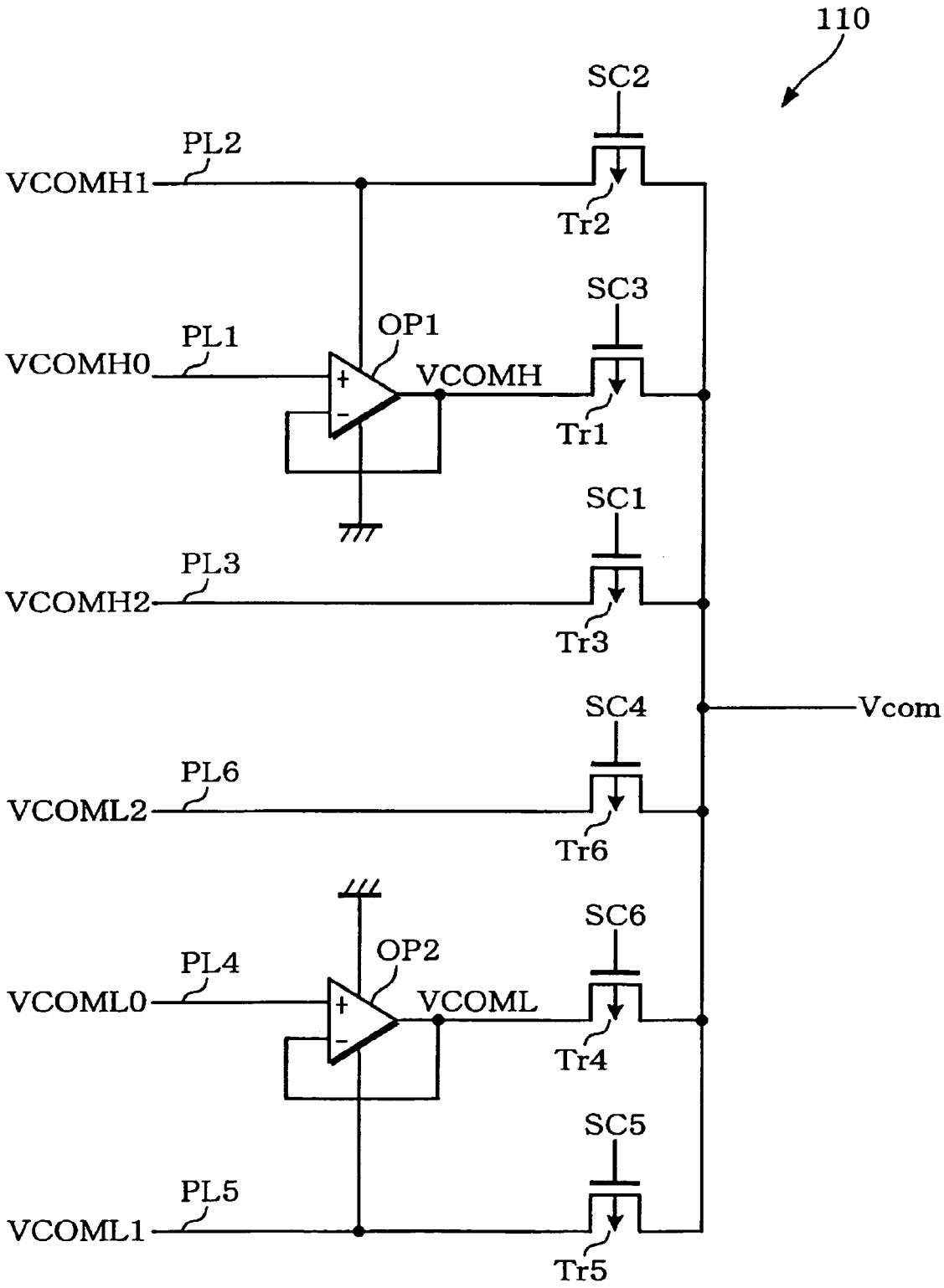
FIG. 14 is a circuit diagram showing a configuration example of a common electrode voltage supply circuit.

FIG. 14 shows a configuration example of the common electrode voltage supply circuit 110.

The common electrode voltage supply circuit 110 includes transistors Tr1 to Tr6. The transistors Tr1 to Tr6 are p-type MOS transistors, for example. One end of the transistors Tr1 to Tr6 is connected in common with the common electrode.

The output of a first operational amplifier OP1 is connected with the other end of the transistor Tr1. The output of the first operational amplifier OP1 is also connected with an inverting input terminal (negative feedback). Specifically, the first operational amplifier OP1 is voltage follower connected. A non-inverting input terminal of the first operational amplifier OP1 is connected with the first power supply line PL1 to which the high-potential-side voltage VCOMH0 is supplied. The high-potential-side power supply voltage of the first operational amplifier OP1 is the second high-potential-side voltage VCOMH1 supplied to the second power supply line PL2. The low-potential-side power supply voltage of the first operational amplifier OP1 is the system ground power supply voltage VSS. The output voltage of the first operational amplifier OP1 becomes the first high-potential-side voltage VCOMH. The transistor Tr1 is ON/OFF controlled by the select signal SC3. Since the configuration of the first operational amplifier OP1 is known in the art, description of the configuration is omitted.

The second power supply line PL2 to which the first high-potential-side voltage VCOMH1 is supplied is connected with the other end of the transistor Tr2. The transistor Tr2 is ON/OFF controlled by the select signal SC2.

The third power supply line PL3 to which the first intermediate voltage VCOMH2 is supplied is connected with the other end of the transistor Tr3. The transistor Tr3 is ON/OFF controlled by the select signal SC1.

The output of a second operational amplifier OP2 is connected with the other end of the transistor Tr4. The output of the second operational amplifier OP2 is also connected with an inverting input terminal (negative feedback). Specifically, the second operational amplifier OP2 is voltage follower connected. A non-inverting input terminal of the second operational amplifier OP2 is connected with the fourth power supply line PL4 to which the low-potential-side voltage VCOML0 is supplied. The high-potential-side power supply voltage of the second operational amplifier OP2 is the system ground power supply voltage VSS. The low-potential-side power supply voltage of the first operational amplifier OP1 is the second low-potential-side voltage VCOML1 supplied to the fifth power supply line PL5. The output voltage of the second operational amplifier OP2 becomes the first low-potential-side voltage VCOML. The transistor Tr4 is ON/OFF controlled by the select signal SC6. Since the configuration of the first operational amplifier OP1 is known in the art, description of the configuration is omitted.

The fifth power supply line PL5 to which the first low-potential-side voltage VCOML1 is supplied is connected with the other end of the transistor Tr5. The transistor Tr5 is ON/OFF controlled by the select signal SC5.

The sixth power supply line PL6 to which the second intermediate voltage VCOML2 is supplied is connected with the other end of the transistor Tr6. The transistor Tr6 is ON/OFF controlled by the select signal SC4.

The transistors Tr1 to Tr3 are controlled so that the transistors Tr1 to Tr3 are exclusively turned ON based on the select signals SC1 to SC3 when the polarity designated by the polarity reversal signal POL is a first polarity. The common electrode voltage Vcom can be set at the first high-potential-side voltage VCOMH with high accuracy by allowing the voltage-follower-connected operational amplifier as impedance transformation means to output the first high-potential-side voltage VCOMH.

The transistors Tr4 to Tr6 are controlled so that the transistors Tr4 to Tr6 are exclusively turned ON based on the select signals SC4 to SC6 when the polarity designated by the polarity reversal signal POL is a second polarity. The common electrode voltage Vcom can be set at the first low-potential-side voltage VCOML with high accuracy by allowing the voltage-follower-connected operational amplifier as impedance transformation means to output the first low-potential-side voltage VCOML.

Moreover, since the second high-potential-side voltage VCOMH1, the first intermediate voltage VCOMH2, the second low-potential-side voltage VCOML1, and the second intermediate voltage VCOML2, for which highly accurate regulation of the voltage level is unnecessary, are not output using the operational amplifier, power consumption can be reduced. Furthermore, power consumption can be reduced by providing the first and second operational amplifiers OP1 and OP2 in comparison with the case of using the operational amplifier between the first high-potential-side voltage VCOMH and the first low-potential-side voltage VCOML.

Figure 15:
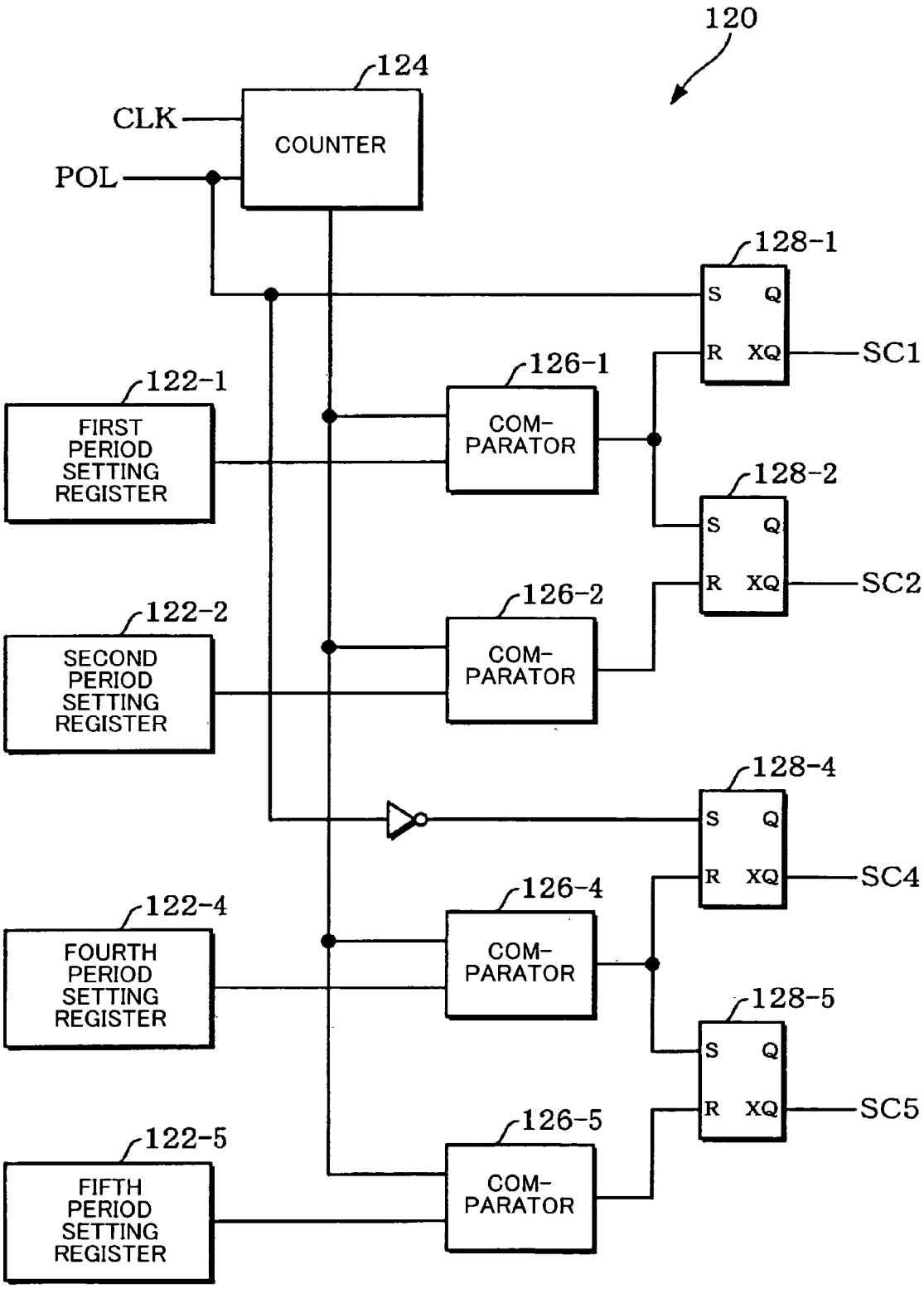
FIG. 15 shows a configuration example of a switch control circuit.
Figure 16:
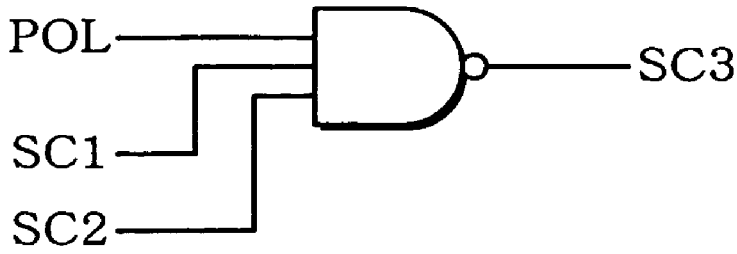
FIG. 16 shows another configuration example of a switch control circuit.
Figure 17:
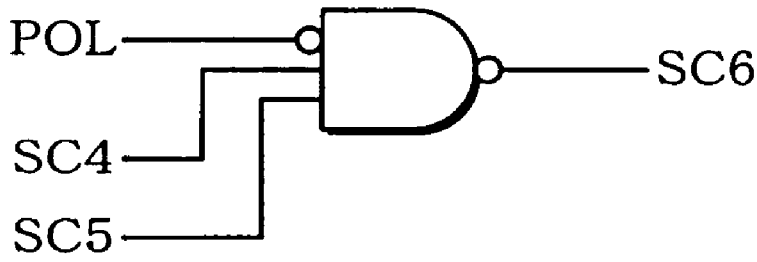
FIG. 17 shows a further configuration example of a switch control circuit.

FIGS. 15 to 17 show a configuration example of the switch control circuit 120.

The switch control circuit 120 includes first, second, fourth, and fifth period setting registers 122-1, 122-2, 122-4, and 122-5.

The switch control circuit 120 generates the select signal SC1 having a pulse width corresponding to the value set in the first period setting register 122-1. The switch control circuit 120 generates the select signal SC2 having a pulse width corresponding to the value set in the second period setting register 122-2. The switch control circuit 120 generates the select signal SC4 having a pulse width corresponding to the value set in the fourth period setting register 122-4. The switch control circuit 120 generates the select signal SC5 having a pulse width corresponding to the value set in the fifth period setting register 122-5.

The values are set in the first, second, fourth, and fifth period setting registers 122-1, 122-2, 122-4, and 122-5 by the display controller 38.

The switch control circuit 120 includes a counter 124, comparators 126-1, 126-2, 126-4, and 126-5, and RS flip-flops (hereinafter abbreviated as "FF") 128-1, 128-2, 128-4, and 128-5.

The counter 124 counts up in synchronization with a given clock signal based on the change point of the polarity reversal signal POL.

The comparator 126-1 compares the counter value of the counter 124 with the value set in the first period setting register 122-1, and outputs a pulse when these values coincide. The RSFF 128-1 is set when the polarity reversal signal POL changes to an H level, and is reset when the comparator 126-1 detects that the counter value of the counter 124 coincides with the value set in the first period setting register 122-1. The select signal SC1 is a signal output from an inverting output terminal XQ of the RSFF 128-1. This configuration enables the first period T1 which is started when the polarity reversal signal POL changes to the H level and corresponds to the value set in the first period setting register 122-1 to be designated.

The comparator 126-2 compares the counter value of the counter 124 with the value set in the second period setting register 122-2, and outputs a pulse when these values coincide. The RSFF 128-2 is set when the RSFF 128-1 is reset, and is reset when the comparator 126-2 detects that the counter value of the counter 124 coincides with the value set in the second period setting register 122-2. The select signal SC2 is a signal output from an inverting output terminal XQ of the RSFF 128-2. This configuration enables the second period T2 which is started after the first period T1 and corresponds to the value set in the second period setting register 122-2 to be designated.

The comparator 126-4 compares the counter value of the counter 124 with the value set in the fourth period setting register 122-4, and outputs a pulse when these values coincide. The RSFF 128-4 is set when the polarity reversal signal POL changes to the L level, and is reset when the comparator 126-4 detects that the counter value of the counter 124 coincides with the value set in the fourth period setting register 122-4. The select signal SC4 is a signal output from an inverting output terminal XQ of the RSFF 128-4. This configuration enables the fourth period T4 which is started when the polarity reversal signal POL changes to the L level and corresponds to the value set in the fourth period setting register 122-4 to be designated.

The comparator 126-5 compares the counter value of the counter 124 with the value set in the fifth period setting register 122-5, and outputs a pulse when these values coincide. The RSFF 128-5 is set when the RSFF 128-4 is reset, and is reset when the comparator 126-5 detects that the counter value of the counter 124 coincides with the value set in the fifth period setting register 122-5. The select signal SC5 is the signal output from an inverting output terminal XQ of the RSFF 128-5. This configuration enables the fifth period T5 which is started after the fourth period T4 and corresponds to the value set in the fifth period setting register 122-5 to be designated.

The switch control circuit 120 can designate the first, second, fourth, and fifth periods T1, T2, T4, and T5 based on the change point of the polarity reversal signal POL by the select signals SC1, SC2, SC4, and SC5 as described above.

The select signal SC3 which designates the third period T3 is generated based on the polarity reversal signal POL and the select signals SC1 and SC2, as shown in FIG. 16.

The select signal SC6 which designates the sixth period T6 is generated based on the polarity reversal signal POL and the select signals SC4 and SC5, as shown in FIG. 17.

Figure 18:
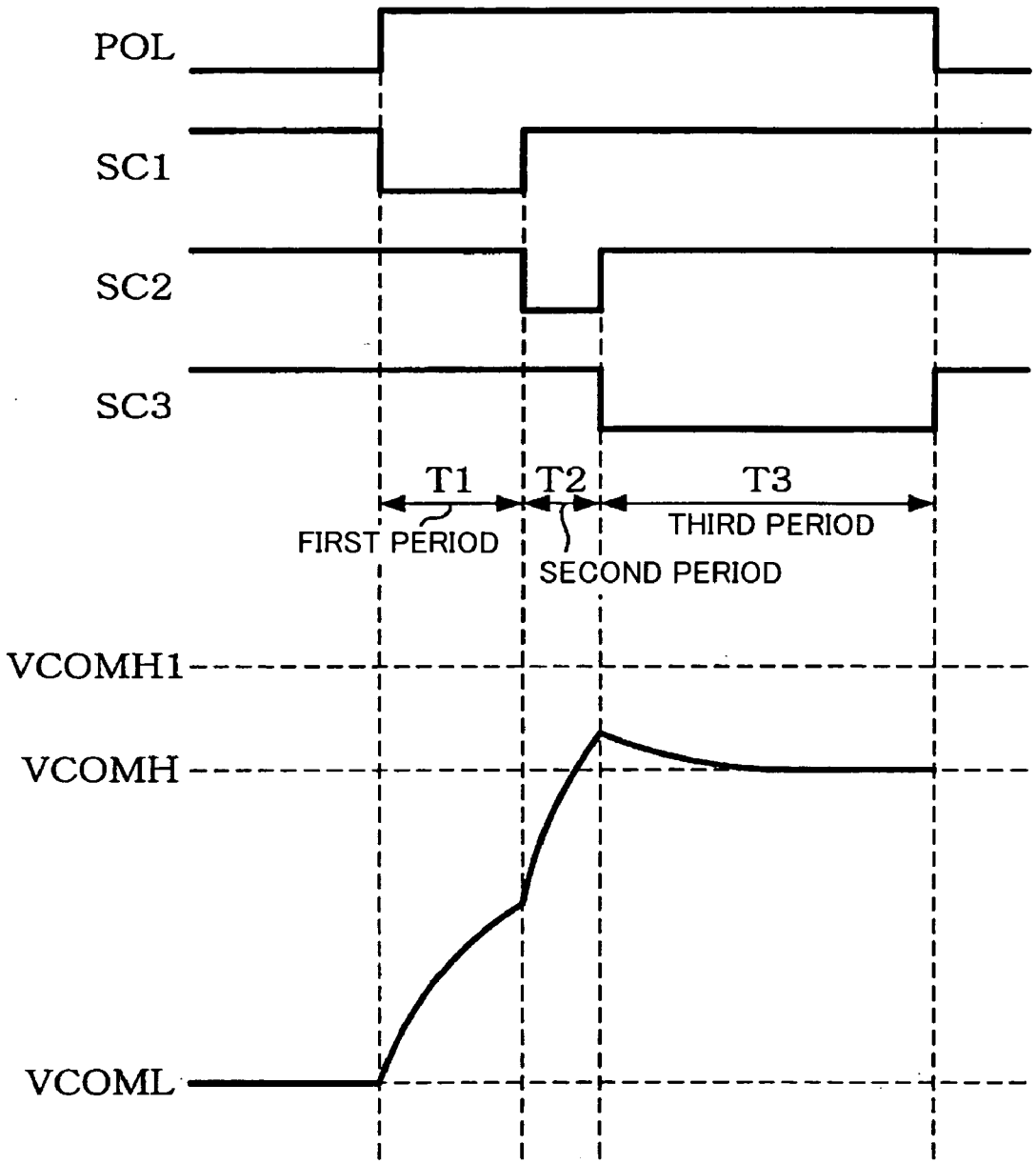
FIG. 18 describes an example of a change in potential of a common electrode based on a select signal.

FIG. 18 shows an example of a change in potential of the common electrode based on the select signals SC1 to SC3.

When the polarity reversal signal POL changes from the L level to the H level, the voltage supplied to the common electrode is changed from the first low-potential-side voltage VCOML to the first high-potential-side voltage VCOMH. The select signals SC1 to SC3 are generated by the circuits shown in FIGS. 15 and 16.

Therefore, the third power supply line PL3 to which the first intermediate voltage VCOMH2 is supplied is electrically connected with the common electrode in the first period T1. This allows the first intermediate voltage VCOMH2 to be supplied to the common electrode in the first period T1.

In the second period T2, the second power supply line PL2 to which the second high-potential-side voltage VCOMH1 is supplied is electrically connected with the common electrode. Therefore, the second high-potential-side voltage VCOMH1 is supplied to the common electrode in the second period T2.

In the third period T3, the output of the first operational amplifier OP1 is electrically connected with the common electrode. Therefore, allows the voltage of the common electrode is driven by the first operational amplifier OP1 in the third period T3, whereby the common electrode is set at the first high-potential-side voltage VCOMH.

Figure 19:
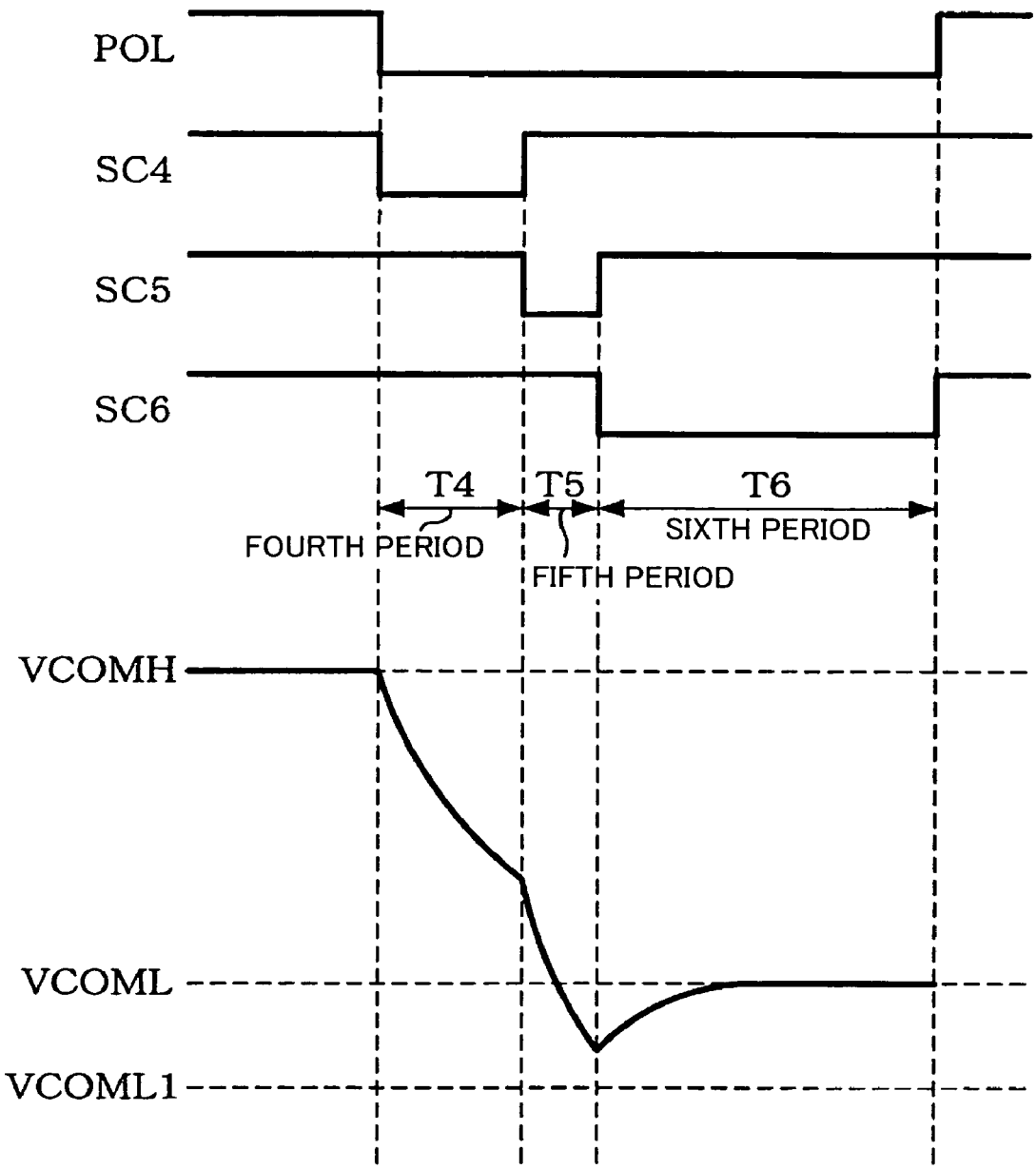
FIG. 19 describes another example of a change in potential of a common electrode based on a select signal.

FIG. 19 shows an example of a change in potential of the common electrode based on the select signals SC4 to SC6.

When the polarity reversal signal POL changes from the H level to the L level, the voltage supplied to the common electrode is changed from the first high-potential-side voltage VCOMH to the first low-potential-side voltage VCOML. The select signals SC4 to SC6 are generated by the circuit shown in FIGS. 15 and 17.

Therefore, the sixth power supply line PL6 to which the second intermediate voltage VCOML2 is supplied is electrically connected with the common electrode in the fourth period T4. Therefore, the second intermediate voltage VCOML2 is supplied to the common electrode in the fourth period T4.

In the fifth period T5, the fifth power supply line PL5 to which the second low-potential-side voltage VCOML1 is supplied is electrically connected with the common electrode. Therefore, the second low-potential-side voltage VCOML1 is supplied to the common electrode in the fifth period T5.

In the sixth period T6, the output of the second operational amplifier OP2 is electrically connected with the common electrode. Therefore, the voltage of the common electrode is driven by the second operational amplifier OP2 in the sixth period T6, whereby the common electrode is set at the first low-potential-side voltage VCOML.

The common electrode can be charged/discharged at high speed by supplying the voltage at a higher potential or lower potential in the second or fifth period T2 or T5, and supplying the first high-potential-side voltage VCOMH or the first low-potential-side voltage VCOML at which the common electrode should be originally set in the third or sixth period T3 or T6. Moreover, self-power consumption of the transistor as the switch circuit of the common electrode voltage supply circuit 110 can be reduced by applying the first or second intermediate voltage VCOMH2 or VCOML2 to the common electrode in the first or fourth period T1 or T4 before the second or fifth period, whereby power consumption can be reduced.

In FIG. 16, the select signal SC3 is generated based on the polarity reversal signal POL and the select signals SC1 and SC2. However, the present invention is not limited thereto. For example, a third period setting register may be provided in the circuit shown in FIG. 15, and the select signal SC3 may be generated in the same manner as the select signal SC2.

In FIG. 17, the select signal SC6 is generated based on the polarity reversal signal POL and the select signals SC4 and SC5. However, the present invention is not limited thereto. For example, a sixth period setting register may be provided in the circuit shown in FIG. 15, and the select signal SC6 may be generated in the same manner as the select signal SC5.

FIG. 18 illustrates the case where the first intermediate voltage VCOMH2 is supplied to the common electrode in the first period. However, the common electrode may be connected with the output of the first operational amplifier OP1 which outputs the first high-potential-side voltage VCOMH in the first period. This reduces the number of voltage levels generated by the common electrode voltage generation circuit 130, whereby an increase in the circuit scale can be prevented and voltage supply control can be simplified.

FIG. 19 illustrates the case where the second intermediate voltage VCOML2 is supplied to the common electrode in the fourth period. However, the common electrode may be connected with the output of the second operational amplifier OP2 which outputs the first low-potential-side voltage VCOML in the fourth period. This reduces the number of voltage levels generated by the common electrode voltage generation circuit 130, whereby an increase in the circuit scale can be prevented.

The above description illustrates the case where the power supply circuit 100 in the present embodiment supplies voltage to the common electrode by using the select signal when the polarity reversal signal POL changes from the L level to the H level and changes from the H level to the L level. However, the present invention is not limited thereto. The power supply circuit 100 may supply voltage to the common electrode by the select signal only when the polarity reversal signal POL changes from the L level to the H level or changes from the H level to the L level.

The above description illustrates the case where the power supply circuit 100 in the present embodiment supplies voltage in three stages when changing the voltage of the common electrode. However, the present invention is not limited thereto. For example, the power supply circuit 100 may change the voltage of the common electrode by supplying voltage in two stages. For example, the power supply circuit 100 may change the voltage of the common electrode by using only the select signals SC2 and SC3. The power supply circuit 100 may change the voltage of the common electrode by using only the select signals SC5 and SC6.

Figure 20:
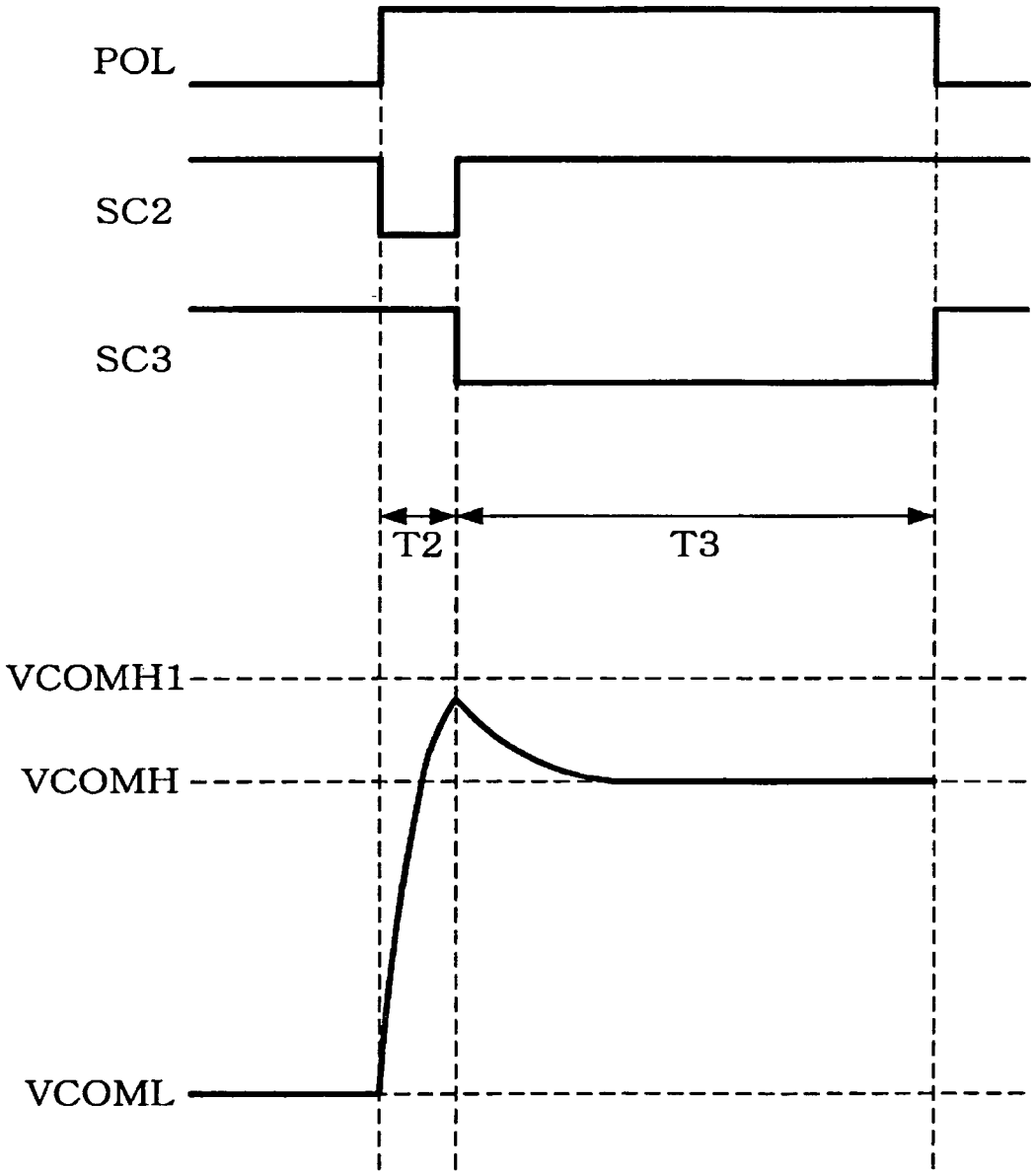
FIG. 20 describes an example of a change in potential of a common electrode in two stages based on a select signal.

FIG. 20 shows an example of a change in potential of the common electrode based on the select signals SC2 to SC3.

When the polarity reversal signal POL changes from the L level to the H level, the voltage supplied to the common electrode is changed from the first low-potential-side voltage VCOML to the first high-potential-side voltage VCOMH. The select signals SC2 and SC3 are generated by the circuit shown in FIGS. 15 and 16. A third period setting register may be provided in FIG. 15, and the select signal SC3 may be generated in the same manner as the select signal SC2.

In this case, the second power supply line PL2 to which the second high-potential-side voltage VCOMH1 is supplied is electrically connected with the common electrode in the second period T2. Therefore, the second high-potential-side voltage VCOMH1 is supplied to the common electrode in the second period T2.

In the third period T3, the output of the first operational amplifier OP1 is electrically connected with the common electrode. Therefore, the voltage of the common electrode is driven by the first operational amplifier OP1 in the third period T3, whereby the first high-potential-side voltage VCOMH is supplied to the common electrode.

Figure 21:
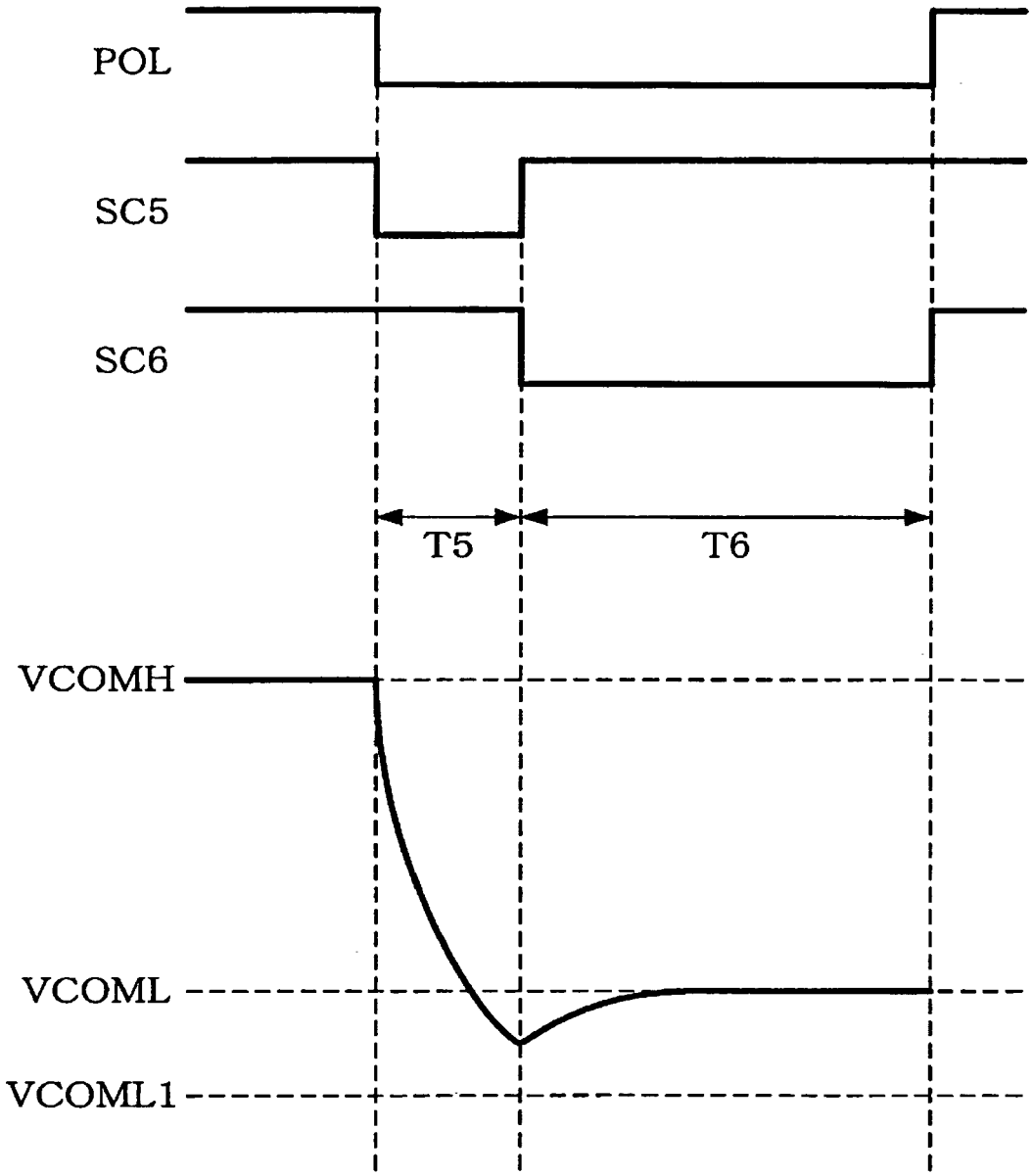
FIG. 21 describes another example of a change in potential of a common electrode in two stages based on a select signal.

FIG. 21 shows an example of a change in potential of the common electrode based on the select signals SC5 to SC6.

When the polarity reversal signal POL changes from the H level to the L level, the voltage supplied to the common electrode is changed from the first high-potential-side voltage VCOMH to the first low-potential-side voltage VCOML. The select signals SC5 and SC6 are generated by the circuits shown in FIGS. 15 and 17. A sixth period setting register may be provided in FIG. 15, and the select signal SC6 may be generated in the same manner as the select signal SC5.

In this case, the fifth power supply line PL5 to which the second low-potential-side voltage VCOML1 is supplied is electrically connected with the common electrode in the fifth period T5. Therefore, the second low-potential-side voltage VCOML1 is supplied to the common electrode in the fifth period T5.

In the sixth period T6, the output of the second operational amplifier OP2 is electrically connected with the common electrode. Therefore, the voltage of the common electrode is driven by the second operational amplifier OP2 in the sixth period T6, whereby the common electrode is set at the first low-potential-side voltage VCOML.

Self-power consumption of the transistor and power consumption of the first and second operational amplifiers cannot be reduced by supplying voltage to the common electrode as shown in FIG. 20 or 21. However, a highly accurate voltage can be set to the common electrode.

3. Display Driver

The power supply circuit 100 in the present embodiment may be provided in the display driver 30.

Figure 22:
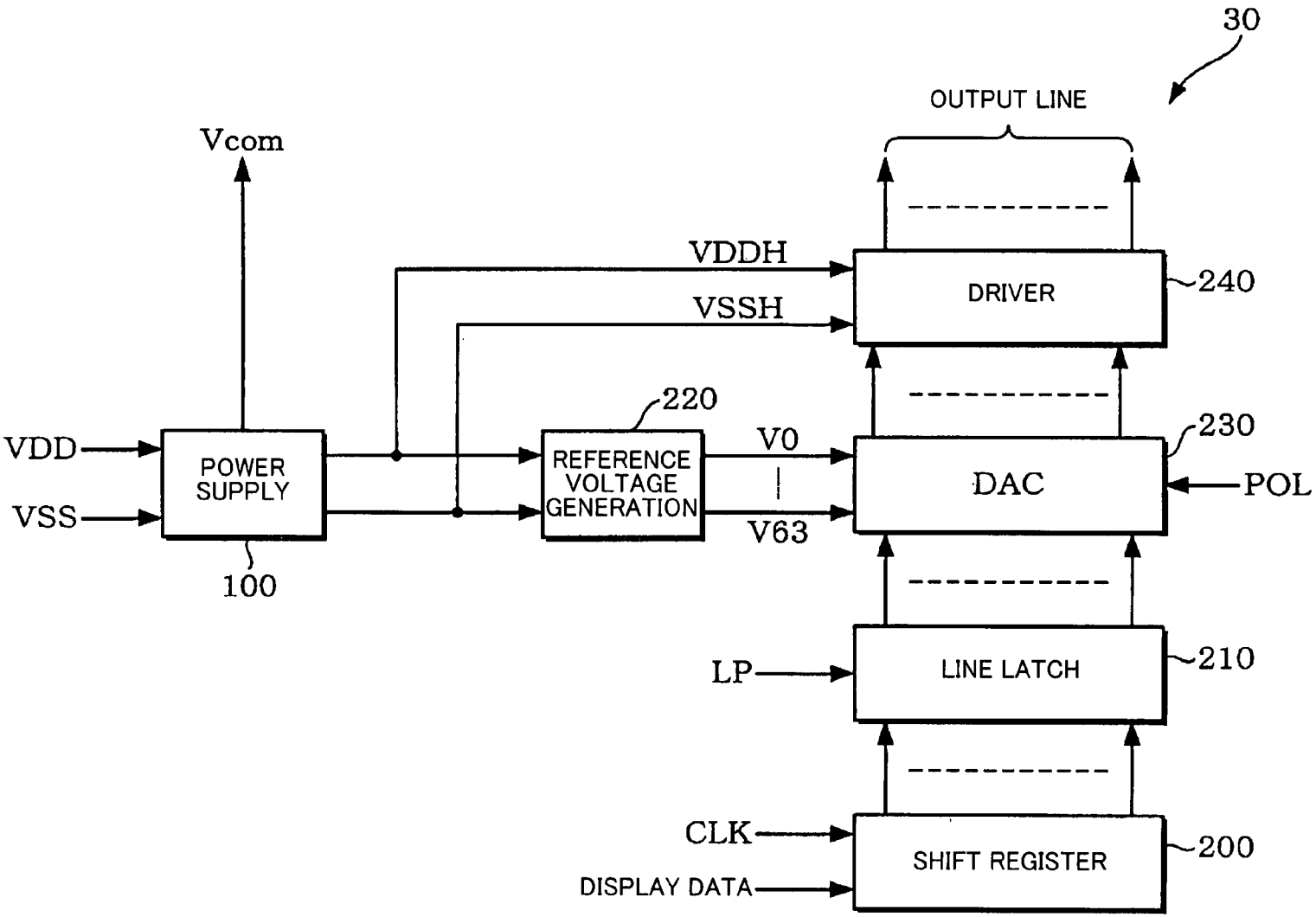
FIG. 22 is a block diagram of a configuration example of a display driver in an embodiment of the present invention.

FIG. 22 shows a block diagram of a configuration example of the display driver 30 in the present embodiment.

The display driver 30 includes a shift register 200, a line latch 210, a reference voltage generation circuit 220, a digital/analog converter (DAC) 230 (voltage select circuit in a broad sense), a driver circuit 240, and the power supply circuit 100.

The shift register 200 fetches display data for one horizontal scanning period by shifting the display data input in series in pixel units in synchronization with a clock signal CLK, for example. The clock signal CLK is supplied from the display controller 38.

In the case where one pixel is made up of an R signal, G signal, and B signal, six bits each, one pixel is made up of 18 bits.

The display data fetched by the shift register 200 is latched by the line latch 210 at timing of a latch pulse signal LP. The latch pulse signal LP is input at a horizontal scanning cycle timing.

The reference voltage generation circuit 220 generates a plurality of reference voltages, each of the reference voltages corresponding to display data. In more detail, the reference voltage generation circuit 220 generates a plurality of reference voltages V0 to V63, each of the reference voltages corresponding to 6-bit display data, based on the high-potential-side power supply voltage VDDH and the low-potential-side power supply voltage VSSH.

The DAC 230 generates a drive voltage corresponding to the display data output from the line latch 210 in output line units. In more detail, the DAC 230 selects the reference voltage corresponding to the display data for one output line which is output from the line latch 210 from the reference voltages V0 to V63 generated by the reference voltage generation circuit 220, and outputs the selected reference voltage as the drive voltage.

The driver circuit 240 drives a plurality of output lines, each of the output lines being connected with one of the data lines of the liquid crystal display panel 20. In more detail, the driver circuit 240 drives the output line based on the drive voltage generated by the DAC 230 in output line units. The driver circuit 240 includes a plurality of data line driver circuits DRV-1 to DRV-N, each of the data line driver circuits corresponding to one output line. The data line driver circuits DRV-1 to DRV-N are formed by voltage-follower-connected operational amplifiers.

The power supply circuit 100 supplies voltage to the common electrode of the liquid crystal display panel 20 as described above, and generates the high-potential-side power supply voltage VDDH and the low-potential-side power supply voltage VSSH based on the voltage between the system power supply voltage VDD and the system ground power supply voltage VSS. The high-potential-side power supply voltage VDDH and the low-potential-side power supply voltage VSSH are supplied to the reference voltage generation circuit 220 and the driver circuit 240.

In the display driver 30 having the above-described configuration, the display data for one horizontal scanning period fetched by the shift register 200 is latched by the line latch 210, for example. The drive voltage is generated in output line units by using the display data latched by the line latch 210. The driver circuit 240 drives each output line based on the drive voltage generated by the DAC 230.

Figure 23:
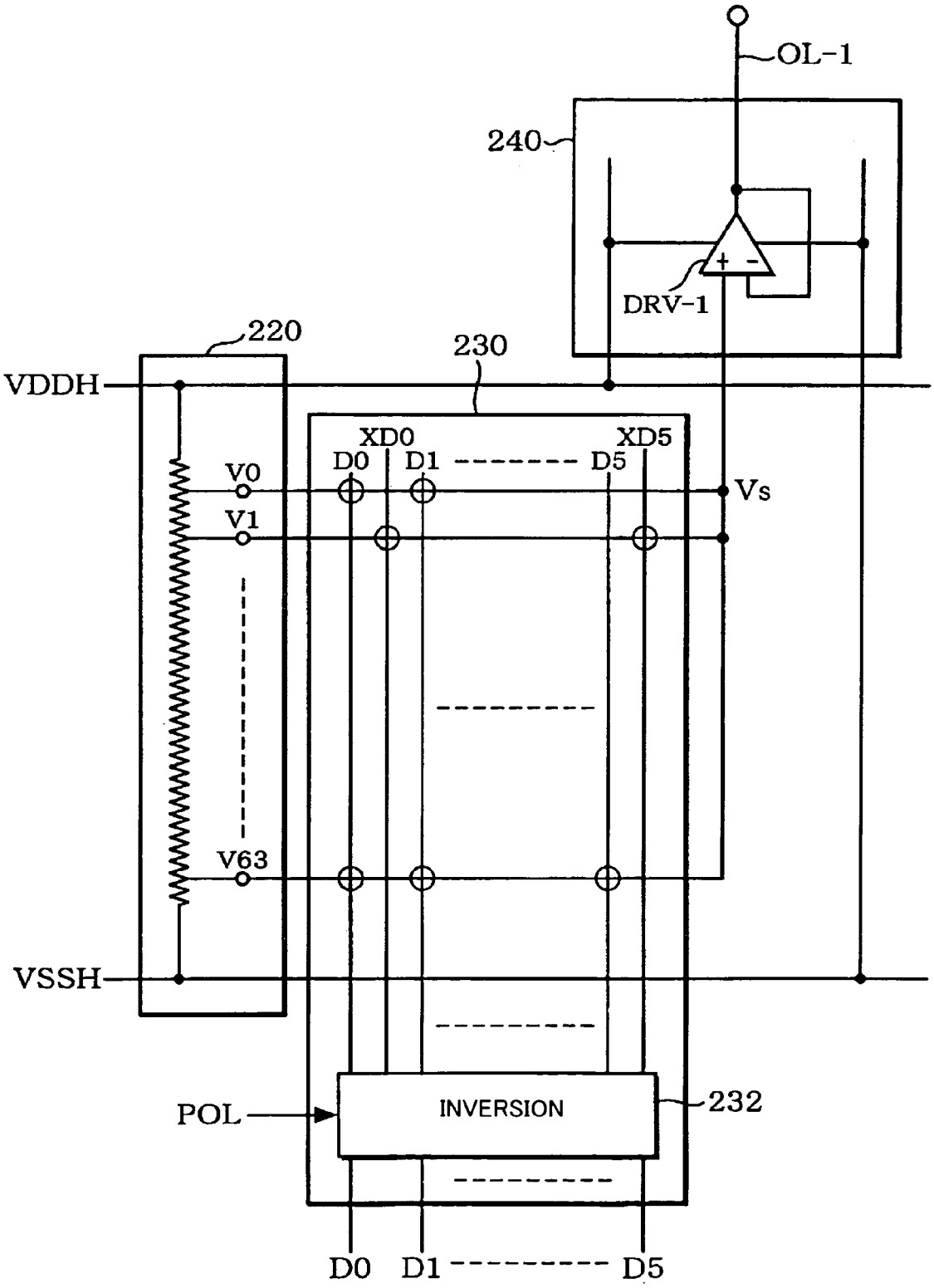
FIG. 23 shows an outline of a configuration of a reference voltage generating circuit, DAC, and driver circuit.

FIG. 23 shows an outline of a configuration of the reference voltage generation circuit 220, the DAC 230, and the driver circuit 240. FIG. 23 illustrates only the data line driver circuit DRV-1 of the driver circuit 240. However, the same description also applies to other driver circuits.

In the reference voltage generation circuit 220, a resistor circuit is connected between the high-potential-side power supply voltage VDDH and the low-potential-side power supply voltage VSSH. The reference voltage generation circuit 220 generates a plurality of divided voltages obtained by dividing the voltage between the high-potential-side power supply voltage VDDH and the low-potential-side power supply voltage VSSH by using the resistor circuit as the reference voltages V0 to V63. In the polarity reversal drive, since voltages are not symmetrical between the case where the polarity is positive and the case where the polarity is negative, a positive reference voltage and a negative reference voltage are generated. FIG. 23 shows one of them.

The DAC 230 may be realized by a ROM decoder circuit. The DAC 230 selects one of the reference voltages V0 to V63 based on the 6-bit display data, and outputs the selected reference voltage to the data line driver circuit DRV-1 as a select voltage Vs. The voltage selected based on the corresponding 6-bit display data is output to other data line driver circuits DRV-2 to DRV-N.

The DAC 230 includes an inversion circuit 232. The inversion circuit 232 reverses the display data based on the polarity reversal signal POL. The 6-bit display data D0 to D5 and 6-bit reversed display data XD0 to XD5 are input to the DAC 230. The reversed display data XD0 to XD5 is obtained by reversing the display data D0 to D5, respectively. In the DAC 230, one of the multi-valued reference voltages V0 to V63 generated by the reference voltage generation circuit 220 is selected based on the display data.

When the logical level of the polarity reversal signal POL is H, the reference voltage V2 is selected corresponding to the 6-bit display data D0 to D5 "000010" (=2), for example. When the logical level of the polarity reversal signal POL is L, the reference voltage is selected by the reversed display data XD0 to XD5 obtained by reversing the display data D0 to D5. Specifically, the reversed display data XD0 to XD5 becomes "111101" (=61), whereby the reference voltage V61 is selected.

The select voltage Vs selected by the DAC 230 is supplied to the data line driver circuit DRV-1.

The data line driver circuit DRV-1 drives the output line OL-1 based on the select voltage Vs. The power supply circuit 100 changes the voltage of the common electrode in synchronization with the polarity reversal signal POL as described above. The liquid crystal is driven while reversing the polarity of the voltage applied to the liquid crystal in this manner.

The mounting size of the liquid crystal display device 10 can be reduced by providing the power supply circuit 100 in the display driver 30, whereby a display driver which reduces power consumption and prevents deterioration of the image quality can be provided.

The present invention is not limited to the above-described embodiment. Various modifications and variations are possible within the spirit and scope of the present invention. For example, the present invention can be applied not only to drive of the liquid crystal display panel, but also to drive of an electroluminescent or plasma display device.

The invention according to the dependent claim may have a configuration in which a part of the constituent elements of the claim on which the invention is dependent is omitted. It is possible to allow the feature of the invention according to none independent claim to depend on another independent claim.

What is claimed is:

1. A power supply circuit for supplying voltage to a common electrode which faces a pixel electrode through an electro-optical substance, the power supply circuit comprising:

a common electrode voltage supply circuit which supplies one of a first high-potential-side voltage, a first low-potential-side voltage, a second high-potential-side voltage, and a first intermediate voltage to the common electrode based on a select signal, the second high-potential-side voltage being higher than the first high-potential-side voltage; and a switch control circuit which generates the select signal by using a polarity reversal signal which designates polarity reversal timing of voltage applied to the electro-optical substance, wherein the first intermediate voltage is higher than the first low-potential-side voltage and lower than the first high-potential-side voltage, and wherein, when the common electrode voltage supply circuit changes the voltage of the common electrode from the first low-potential-side voltage to the first high-potential-side voltage, the common electrode voltage supply circuit supplies the first high-potential-side voltage or the first intermediate voltage to the common electrode in a first period, supplies the second high-potential-side voltage to the common electrode in a second period after the first period, and supplies the first high-potential-side voltage to the common electrode in a third period after the second period.

2. The power supply circuit as defined in claim 1, wherein the common electrode voltage supply circuit supplies one of the first high-potential-side voltage, the first low-potential-side voltage, the second high-potential-side voltage, the first intermediate voltage, a second low-potential-side voltage, and a second intermediate voltage to the common electrode based on the select signal, the second low-potential-side voltage being lower than the first low-potential-side voltage, wherein the second intermediate voltage is higher than the first low-potential-side voltage and lower than the first high-potential-side voltage, and wherein, when the common electrode voltage supply circuit changes the voltage of the common electrode from the first high-potential-side voltage to the first low-potential-side voltage, the common electrode voltage supply circuit supplies the first low-potential-side voltage or the second intermediate voltage to the common electrode in a fourth period, supplies the second low-potential-side voltage to the common electrode in a fifth period after the fourth period, and supplies the first low-potential-side voltage to the common electrode in a sixth period after the fifth period.

3. The power supply circuit as defined in claim 2, comprising:

first and second period setting registers for setting the first and second periods, respectively, wherein the switch control circuit designates the first and second periods based on a change point of the polarity reversal signal by using the select signal having a pulse width corresponding to a value set in each of the first and second period setting registers.

4. The power supply circuit as defined in claim 2, comprising:

fourth and fifth period setting registers for setting the fourth and fifth periods, respectively, wherein the switch control circuit designates the fourth and fifth periods based on a change point of the polarity reversal signal by using the select signal having a pulse width corresponding to a value set in each of the fourth and fifth period setting registers.

5. The power supply circuit as defined in claim 1, comprising:

first and second period setting registers for setting the first and second periods, respectively, wherein the switch control circuit designates the first and second periods based on a change point of the polarity reversal signal by using the select signal having a pulse width corresponding to a value set in each of the first and second period setting registers.

6. The power supply circuit as defined in claim 1, wherein the common electrode voltage supply circuit includes a voltage-follower-connected first operational amplifier which generates the first high-potential-side voltage, a given voltage being supplied to an input of the first operational amplifier, and wherein the second high-potential-side voltage is a high-potential-side power supply voltage of the first operational amplifier.

7. The power supply circuit as defined in claim 1, wherein the common electrode voltage supply circuit includes a voltage-follower-connected second operational amplifier which generates the second high-potential-side voltage, a given voltage being supplied to an input of the second operational amplifier, and wherein the second low-potential-side voltage is a low-potential-side power supply voltage of the second operational amplifier.

8. A display driver comprising:

the power supply circuit as defined in claim 1 which supplies voltage to the common electrode; and a driver circuit which drives a data line connected with the pixel electrode through a switching device based on display data.

9. A power supply circuit for supplying voltage to a common electrode which faces a pixel electrode through an electro-optical substance, the power supply circuit comprising:

a common electrode voltage supply circuit which supplies one of a first high-potential-side voltage, a first low-potential-side voltage, a second low-potential-side voltage, and a second intermediate voltage to the common electrode based on a select signal, the second low-potential-side voltage being lower than the first low-potential-side voltage; and a switch control circuit which generates the select signal by using a polarity reversal signal which designates polarity reversal timing of voltage applied to the electro-optical substance, wherein the second intermediate voltage is higher than the first low-potential-side voltage and lower than the first high-potential-side voltage, and wherein, when the common electrode voltage supply circuit changes the voltage of the common electrode from the first high-potential-side voltage to the first low-potential-side voltage, the common electrode voltage supply circuit supplies the first low-potential-side voltage or the second intermediate voltage to the common electrode in a fourth period, supplies the second low-potential-side voltage to the common electrode in a fifth period after the fourth period, and supplies the first low-potential-side voltage to the common electrode in a sixth period after the fifth period.

10. The power supply circuit as defined in claim 9, comprising:

fourth and fifth period setting registers for setting the fourth and fifth periods, respectively, wherein the switch control circuit designates the fourth and fifth periods based on a change point of the polarity reversal signal by using the select signal having a pulse width corresponding to a value set in each of the fourth and fifth period setting registers.

11. The power supply circuit as defined in claim 9, wherein the common electrode voltage supply circuit includes a voltage-follower-connected first operational amplifier which generates the first high-potential-side voltage, a given voltage being supplied to an input of the first operational amplifier, and wherein the second high-potential-side voltage is a high-potential-side power supply voltage of the first operational amplifier.

12. The power supply circuit as defined in claim 9, wherein the common electrode voltage supply circuit includes a voltage-follower-connected second operational amplifier which generates the second high-potential-side voltage, a given voltage being supplied to an input of the second operational amplifier, and wherein the second low-potential-side voltage is a low-potential-side power supply voltage of the second operational amplifier.

13. A display driver comprising:

the power supply circuit as defined in claim 9 which supplies voltage to the common electrode; and a driver circuit which drives a data line connected with the pixel electrode through a switching device based on display data.

14. A voltage supply method for supplying voltage to a common electrode which faces a pixel electrode through an electro-optical substance while changing the voltage from a first low-potential-side voltage to a first high-potential-side voltage, the voltage supply method comprising:

supplying a second high-potential-side voltage which is higher than the first high-potential-side voltage to the common electrode, to which the first low-potential-side voltage is supplied, instead of the first low-potential-side voltage; and supplying the first high-potential-side voltage to the common electrode after supplying the second high-potential-side voltage to the common electrode.

15. The voltage supply method as defined in claim 14, comprising:

supplying one of the first high-potential-side voltage and a first intermediate voltage, which is lower than the first high-potential-side voltage and higher than the first low-potential-side voltage, to the common electrode before supplying the second high-potential-side voltage to the common electrode.

16. A voltage supply method for supplying voltage to a common electrode which faces a pixel electrode through an electro-optical substance while changing the voltage from a first high-potential-side voltage to a first low-potential-side voltage, the voltage supply method comprising:

supplying a second low-potential-side voltage which is lower than the first low-potential-side voltage to the common electrode, to which the first high-potential-side voltage is supplied, instead of the first high-potential-side voltage; and supplying the first low-potential-side voltage to the common electrode after supplying the second low-potential-side voltage to the common electrode.

17. The voltage supply method as defined in claim 16, comprising:

supplying one of the first low-potential-side voltage and a second intermediate voltage, which is higher than the first low-potential-side voltage and lower than the first high-potential-side voltage, to the common electrode before supplying the second low-potential-side voltage to the common electrode.

* * * * *